US008613196B2

(12) United States Patent
Kalina

(10) Patent No.: US 8,613,196 B2
(45) Date of Patent: Dec. 24, 2013

(54) PROCESS AND SYSTEM FOR THE CONVERSION OF THERMAL ENERGY FROM A STREAM OF HOT GAS INTO USEFUL ENERGY AND ELECTRICAL POWER

(75) Inventor: Alexander I. Kalina, Hillsborough, CA (US)

(73) Assignee: Kalex, LLC, Belmont, CA (US)

( * ) Notice: Subject to any disclaimer, the term of this patent is extended or adjusted under 35 U.S.C. 154(b) by 485 days.

(21) Appl. No.: 12/909,205

(22) Filed: Oct. 21, 2010

(65) Prior Publication Data

US 2012/0096862 A1 Apr. 26, 2012

(51) Int. Cl.
*F01K 25/06* (2006.01)
*F01K 25/08* (2006.01)

(52) U.S. Cl.
USPC ..... 60/673; 60/649; 60/651

(58) Field of Classification Search
USPC ..... 60/649, 651, 671, 673
See application file for complete search history.

*Primary Examiner* — Christopher Jetton
(74) *Attorney, Agent, or Firm* — Robert W Strozier, P.L.L.C.

(57) ABSTRACT

A new method, system and apparatus for power system utilizing flue gas streams and a multi-component working fluid is disclosed including a heat recovery vapor generator (HRVG) subsystem, a multi-stage energy conversion or turbine subsystem and a condensation thermal compression subsystem (CTCSS), where the CTCSS receives a single stream from the turbine subsystem and produces at least one fully condensed stream.

33 Claims, 3 Drawing Sheets

PROCESS AND SYSTEM FOR THE CONVERSION OF THERMAL ENERGY FROM A STREAM OF HOT GAS INTO USEFUL ENERGY AND ELECTRICAL POWER

BACKGROUND OF THE INVENTION

1. Field of the Invention

Embodiments of the processes and systems of this invention are designed for the efficient conversion of thermal energy from the exhaust flue gas stream, such as flue gas stream from a gas turbine, but equally to any hot flue gas stream, into useful electrical power. The processes and systems of this invention are thus bottoming cycles for combined cycle systems.

More particularly, embodiments of the processes and systems of this invention relate to the efficient conversion of a portion of the thermal energy in a hot external gas stream into a useable from of energy, where the system includes two sub-systems, a boiler-turbine sub-system in which a condensed working is vaporized or vaporized and superheated by a gaseous external heat source stream and a portion of its thermal energy is converted via a turbine component into a useable form of energy such as electric power, and a condensation thermal compression sub-system (CTCSS), where a spent working solution stream is condensed at reduced pressure, i.e., at pressure which is lower than the pressure of condensation achievable at any given ambient temperature, to from a rich solution stream and a lean solution stream that are heated in lowers sections of the boiler component to form streams that when mixed from a working solution stream where the temperature of the two streams and the combined stream are equal or substantially equal as that term is defined herein.

2. Description of the Related Art

Power systems with thermodynamical power cycles utilizing multi-component working fluids can attain a higher efficiency than power systems utilizing single-component working fluids. Multi-component working fluids condense at variable temperatures. Such working fluids, unlike single component working fluids, have a thermodynamical potential to perform useful work even when sent into a condenser after expansion in a turbine.

Therefore, in the prior art, several power systems that utilized a multi-component working fluid, were designed to have condensation occur in special subsystems which were referred to as distillation condensation subsystems. In this application, such a subsystems will be referred to as a Condensation and Thermal Compression Subsystems (CTCSS), a term that more accurately describes the nature of such subsystems. Such subsystems all work on the following principle: A stream of working fluid subject to condensation enters into the CTCSS at a pressure which is substantially lower than the pressure required for the complete condensation of such a stream at a given ambient temperature. The stream of working fluid is mixed with a recirculating stream of lean solution (i.e., a stream with a substantially lower concentration of the low-boiling component), forming a new stream which can be fully condensed at the given ambient temperature, (referred to as the "basic solution"). Thereafter, the basic solution stream is pumped to a pressure which is slightly higher than the pressure required for the condensation of the working fluid, and is subjected to partial re-vaporization, for which heat that was released in the process of condensation is utilized. Then, the partially vaporized basic solution stream is separated into a lean liquid stream having a reduced concentration of the low-boiling component and a rich vapor stream having a higher concentration of the low-boiling component. The lean liquid stream is then mixed with the condensing stream of working solution (as described above), while the rich vapor stream is combined with a portion of the basic solution stream to reconstitute the initial composition of the working fluid, which is then fully condensed.

In U.S. Pat. No. 4,489,563, the most basic and elementary CTCSS has been described. In this very simple CTCSS, heat from rich vapor stream and lean liquid stream produced by partial re-vaporization is not recuperated, drastically reducing the efficiency of this simple CTCSS.

Although other CTCSS have been disclosed such as those set forth U.S. Pat. Nos. 4,548,043; 4,586,340; 4,604,867; 4,763,480; 5,095,708; and 5,572,871, these CTCSS systems are more complicated and elaborate and cannot be easily modified to improve their efficiency or the efficiency of an overall energy extraction system, where the patent are incorporated by reference by the operation of the closing paragraph of the Detailed Description of the Invention.

More recently, newer CTCSS configurations have been disclosed such as those set forth in U.S. Pat. Nos. 7,043,919 and 7,197,876, which are incorporated by reference by the operation of the closing paragraph of the Detailed Description of the Invention. However, there is still a need in the art for a Condensation and Thermal Compression Subsystem (CTCSS) and systems based on it with improved efficiency of the energy extraction process from gaseous heat source streams.

SUMMARY OF THE INVENTION

Embodiments of systems of the present invention include systems comprising two sub-systems, a boiler-turbine subsystem in which a condensed working is vaporized or vaporized and superheated by an external heat source stream and thermal energy in the vaporized or vaporized and superheated working fluid is converted via gas turbine into power, and a condensation thermal compression sub-system (CTCSS) in which a spent working fluid is condensed at reduced pressure, i.e., at pressure which is lower than the pressure of condensation achievable at any given ambient temperature.

Embodiments of methods of the present invention include methods for implementing systems comprising two sub-systems, a boiler-turbine sub-system in which a condensed working is vaporized or vaporized and superheated by an external heat source stream and thermal energy in the vaporized or vaporized and superheated working fluid is converted via gas turbine into power, and a condensation thermal compression sub-system (CTCSS) in which a spent working fluid is condensed at reduced pressure, i.e., at pressure which is lower than the pressure of condensation achievable at any given ambient temperature.

BRIEF DESCRIPTION OF THE DRAWINGS

The invention can be better understood with reference to the following detailed description together with the appended illustrative drawings in which like elements are numbered the same.

DETAILED DESCRIPTION OF THE INVENTION

The inventor has found that a system can be constructed including two sub-systems, a boiler-turbine sub-system in which a condensed working is vaporized or vaporized and superheated by an external heat source stream and thermal energy in the vaporized or vaporized and superheated working fluid is converted via gas turbine into power, and a condensation thermal compression sub-system (CTCSS) in which a spent working fluid is condensed at reduced pressure, i.e., at pressure which is lower than the pressure of condensation achievable at any given ambient temperature. The inventor has found that embodiments of the systems of this invention have improved efficiencies than prior art systems including a CTCSS.

The systems of this invention utilize multi-component working fluids (i.e., fluids including at least two components, a lower boiling point component and a higher boiling point component). The multi-component working fluid assumes various compositions in the system—the streams circulating through the systems have different concentrations of the lower boiling point component compared to the higher boiling point component. The lower boiling component has a substantially lower normal boiling temperature than the other higher boiling component. In certain embodiments, the working fluid comprises an ammonia/water working fluid, with ammonia representing the lower boiling component and water representing the higher boiling component. This working fluid also includes an additive to inhibit high temperature nitridation corrosion of turbine component, which is possible when the lower boiling component comprises ammonia. For additional information on preventing nitridation corrosion the reader is directed to U.S. Pat. No. 6,482,272, incorporated by reference by the operation of the closing paragraph of the Detailed Description of the Invention.

Working fluid streams will designated as "rich solution" streams when the streams include a higher concentration of the lower boiling component and as a "lean solution" streams when the streams include a lower concentration of the lower boiling component or a higher concentration of the higher boiling component.

In the embodiments depicted in the figures below, streams are mixed or combined together using mixing valves as is well known in the art, and streams are split into substreams using splitter or dividing valves as is also well known in the art. These valves are not numerically indicated, but reside where ever two or more streams are combined or where a stream is divided into two or more substreams.

Figure 1:
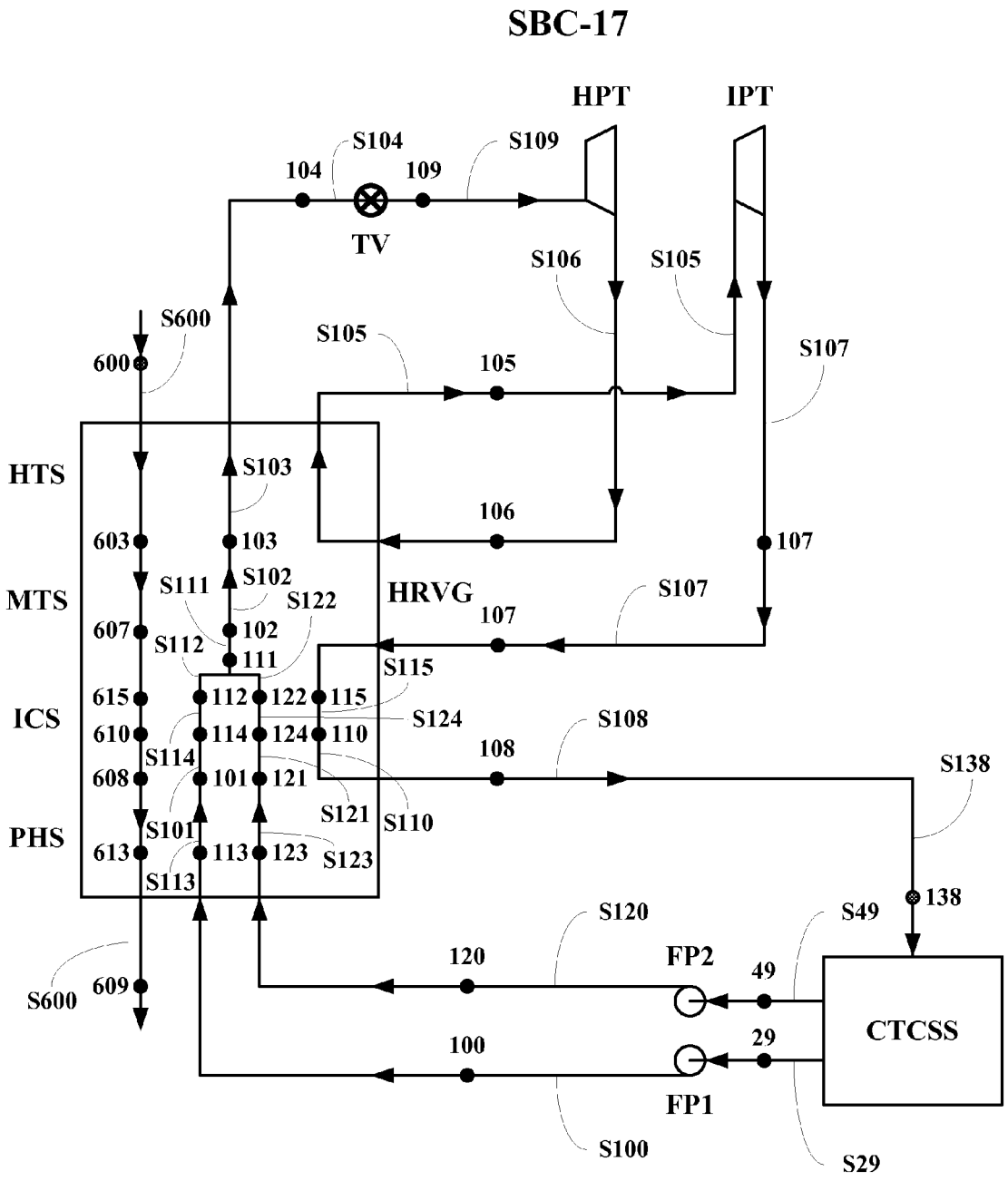
FIG. 1 depicts an embodiment of a system of this invention.

Referring now to FIG. 1, a first embodiment of a system of this invention, generally designated SBC-17, is shown as a flow diagram of the system and the components and operational conditions are described relative to the flow diagram.

A first condensed stream S29 having parameters as a point 29 and a second condensed stream S49 having parameters as a the point 49 exit the CTCSS. The stream S29 having the parameters as at the point 29 comprises a rich solution composition stream of the multi-component fluid having a higher concentration of the lower boiling component than a working solution stream that circulates through the system turbines (see below). The stream S49 having the parameters as at the point 49 comprises a lean solution composition stream of the multi-component fluid having a lower concentration of the lower boiling component of the working solution stream that circulates through the system turbines (see below). Both streams S29 and S49 are in a state of subcooled liquid.

The streams S29 and S49 are now sent into parallel feed pumps FP1 and FP2, respectively, where the stream S29 and S49 are pumped to a higher pressure forming stream S100 and S120, having parameters as at points 100 and 120, respectively. The streams S100 and S120 having the parameters as at the points 100 and 120 are in a state of subcooled higher pressure liquid. The pressures of the S100 and S120 are equal or substantially equal, where the term substantially here means that the pressures are within 10% of being equal. In other embodiments, the pressures are within 8% of being equal. In other embodiments, the pressures are within 6% of being equal. In other embodiments, the pressures are within 4% of being equal. In other embodiments, the pressures are within 2% of being equal.

The composition of the stream S100 is designated as the "rich solution", while the composition of the stream S120 is designated as the "lean solution".

The streams S100 and S120 then enter into a heat recovery vapor generator HRVG, where the stream S100 and S120 are heated by an external heat source stream S600. In certain embodiments, the external heat source stream S600 comprises a hot flue gas stream from turbine exhaust.

In the HRVG, the streams S100 and S120 are first heated to form streams S113 and S123 having initial parameters as at points 113 and 123, respectively, with heat from the external heat source stream S600 now having parameters as at a point 613 forming the S600 now having parameters as at a point 609—spent. The streams S113 and S123 are then further heated to form stream S101 and S121 having parameters as at points 101 and 121, respectively, with heat from the external heat source stream S600 now having parameters as at a point 608.

The section of the HRVG in which heat exchange processes 100-101, 120-121, and 608-609 occur is designated as a pre-heater section PHS.

Thereafter, streams S101 and S121 are further heated as they pass through the HRVG forming steams S114 and S124 having parameters as at points 114 and 124, respectively, with heat from the external heat source stream S600 now having parameters as at a point 610. Thereafter, streams S114 and S124 are yet further heated forming stream S112 and S122 having parameters as at points 112 and 122, correspondingly, with heat from the external heat source stream S600 now having parameters as at a point 615.

In certain embodiments, the rich solution streams S100, S113, S101, S114 and S112 and lean solution streams S120, S123, S121, S124 and S122 of the working fluid are at a supercritical pressure, i.e., the pressure of the streams are higher than a respective critical pressure of the streams.

In heat transfer process 101-112, the rich solution stream S101 is converted from a liquid to a vapor state as the stream S112. In heat transfer process 121-122, the lean solution stream S121 is converted to state of a liquid stream S122 at sub-critical temperature. In the cases where a pressure of the streams S112 and S122 is lower than their critical pressures, then the stream S112 is generally a stream of vapor, whereas the stream 122 may be a liquid stream or a liquid-vapor mixed stream. One of ordinary skill in the art can always find parameters for the stream S112 and S122 so that when the streams S112 and S122 are being mixed, the temperature of the mixed stream S111 will have the same or substantially the same temperature as the temperature of the streams S112 and S122 prior to mixing, where the term substantially here means that the temperatures are within 10% of being equal. In other embodiments, the temperatures are within 8% of being equal. In other embodiments, the temperatures are within 6% of being equal. In other embodiments, the temperatures are within 4% of being equal. In other embodiments, the temperatures are within 2% of being equal. The features of heating a rich solution stream S100 and a lean solution stream S120 in the PHS of the HRVG to a temperatures at which the heated streams may be combined with no or a negligible change in temperature is a unique feature of the present invention.

Thereafter, the streams S112 and S122 are combined to form a working solution stream S111 having parameters as at a point 111. The stream S111 corresponds to a state of vapor.

The purpose of the arrangement of including two streams having different compositions, one a rich solution stream and one a lean solution stream is that the arrangement provides that the overall conversion of streams from liquid to vapor occurs at lower temperatures than would be the case if the two stream were combined from the outset or combined prior to being introduced into the HRVG. The two stream aspect of this embodiment is a unique feature as the splitting of the stream entering into the HRVG permits stream vaporization at lower temperatures than would be the case for a single stream. The feature is also made possible by the multi-component working fluid, which permits streams of different compositions to flow in different parts of the system.

The two streams S112 and S122 are combined at such a point that a temperature of the combined working solution stream S111 having the parameters as at the point 111 is same or substantially the same as temperatures of the streams S112 and S122 having the parameters as at points 112 and 122, respectively, where the term substantially here means that the temperatures are within 10% of being equal. In other embodiments, the temperatures are within 8% of being equal. In other embodiments, the temperatures are within 6% of being equal. In other embodiments, the temperatures are within 4% of being equal. In other embodiments, the temperatures are within 2% of being equal.

Thereafter, the working solution stream S11 having the parameters as at the point 111 is heated to form a heated working solution stream S102 having parameters as at a point 102.

The section of the HRVG in which the heat transfer processes 101-112, 121-122, 111-102, 607-615, and 615-608 occur is designated as the intercooler section ICS of the HRVG.

In the ICS of the HRVG, the upcoming streams S101 and S121 in the heat exchange processes 101-112 and 121-122 are heated not only by the external heat source stream S600 having parameters as at points 607, 615, and 610 (see below), but also by an intercooling stream S107 having parameters as at a point 107 in a heat transfer process 107-108 (see below).

The stream S114 and S124 having the parameters as at the points 114 and 124, respectively, correspond to points in the process at which a temperature difference between the external heat source flue gas stream S600 having the parameters at the point 610 and the streams S114 and S124 having the parameters as at the points 114 and 124 reaches its minimum—the so-called pinch point.

Thereafter, the working solution stream S102 having the parameters as at the point 102 is further heated by the flue gas stream S600 to form a further heated working solution stream S103 having parameters as at a point 103. This section of the HRVG is designated as a mid temperature section MTS of the HRVG.

Thereafter, the stream S103 passes through a high temperature section HTS of the HRVG to form a fully vaporized and superheated stream S104 having parameters as at a point 104, which corresponds to a state of higher pressure, high temperature superheated vapor. The HTS of the HRVG is sometimes also referred as a super-heater/re-heater section SH/RHS of the HRVG.

The external heat source stream S600 with initial parameters as at the point 600 (see above) passes through the HTS of the HRVG, where it is cooled and obtains parameters as at a point 603, transferring heat to the working solution stream S103 in the heat transfer process 103-104 or 600-603.

Thereafter, the external heat source stream S600 having the parameters as at the point 603 passes through the MTS of the HRVG, where it is cooled, transferring heat to the working solution stream S102 having the parameters as at the point 102 in the heat transfer process 102-103, where the stream S600 now have the parameters as at the point 607.

Thereafter, the stream S600 having the parameters as at the point 607 passes through the ICS of the HRVG, where it is further cooled, transferring heat to the streams S101, S114, S112, S121, S124, S122, S111 and S102 in the heat transfers processes 101-112, 121-122, 111-102, 607-615, 615-610 and 610-608 obtaining intermediate sequential parameters as at points 615 and 610, and finally obtains parameters as point 608 (see above).

In heat transfer process 607-615-610-608, the external heat source stream S600 is not only cooled by the upcoming streams S100 and S120, but at the same time is partially heated by the intercooling stream S107 in the heat transfer process 107-115-110-108 (see below).

Thereafter, the external heat source stream S600 having the parameters as at the point 608 passes through the PHS of the HRVG, where it is cooled, transferring heat to the upcoming streams S100 and S120 obtains intermediate parameters as at a point 613, and finally is further cooled, obtaining parameters as at a point 609. The external heat source stream S600 having the parameters as at the point 609 is then released into the stack.

The external heat source stream S600 having parameters as at the point 613, the heat source stream such as flue gas stream, reaches the state of its dew point, i.e., the state at which condensation of water vapor which is part of the flue gas begins. As a result, the parameters of the external heat source stream at the point 609 correspond to a state of wet gas.

Meanwhile, the stream S104 having the parameters as at the point 104 exits the HRGV and passes through an admission valve TV, where its pressure is reduced or adjusted to form a pressure adjusted stream S109 having parameters as at a point 109. The stream S109 now enters into a high pressure turbine HPT, where it is expanded, producing power, and forms a spent HPT stream S106 having parameters as at a point 106.

The spent HPT stream S106 is now sent back into the HTS of the HRVG, where it passes through the HTS section of the HRVG to form a reheated stream S105 having parameters as at a point 105.

The reheated stream S105 is now sent into an intermediate pressure turbine IPT, where it is expanded, producing power, and form a spent IPT stream S107 having parameters as at a point 107.

The stream S107 is now again sent back into the HRVG, into the ICS of the HRVG, where it is cooled in the heat exchange process 107-115-110-108, transferring heat to the external heat source stream S600 in the ICS of the HRVG (see above) and exiting the HRVG as a cooled stream S108 having parameters as at a point 108.

The stream S108 is now re-designated as a stream S138 having parameters as at a point 138 prior to being sent into the Condensation Thermal Compression Subsystem CTCSS.

In the SBC-17 embodiment of the systems of this invention, all expansions occurs in the two turbines HPT and IPT.

After being cooled in the ICS of the HRVG, the working solution stream S108/S138 having the parameters as at the point 108/138 none-the-less remains in a state of superheated vapor.

The use of two streams S100 and S120 having different compositions as described above allows a temperature of the streams S100 and S120 and the combined stream S111 in the process of conversion from liquid to vapor in the ICS of the HRVG to be lower than would be possible with a single combined stream entering the HRVG.

Although many of the embodiments of the systems of this invention, the CTCSS produces two stream having different compositions—a rich stream (i.e., a stream having a higher concentration of the lower boiling component of the multi-component working fluid) and a lean stream (i.e., a stream having a lower concentration of the lower boiling component of the multi-component working fluid), in other embodiments, the two stream can have the same composition. On the other hand, a flow rate of the stream S40 in the CTCSS (see below) can be set to zero meaning that the streams S46, S48 and S49 have zero flow rates and, therefore, stream S120 has a zero flow rate. In these embodiments, only a single stream exits the CTCSS. In those embodiments where the CTCSS produces two separate streams, a condensation pressure is increased in the CTCSS, which has a negative impact on overall performance of the systems. In the embodiments where only a single stream issues from the CTCSS such simplified embodiments of the system can have slightly higher or slightly lower performance compared to the two stream embodiments depending on design and output specifications. Thus, embodiments of the present invention, depending on the choice of the overall working fluid compositions and desired design and output specification, the systems can have operate with a single CTCSS stream, two CTCSS streams having the same composition, or two CTCSS streams having the different compositions. Dual stream embodiments permit vaporization of the CTCSS stream at lower temperature due to the fact that the streams are heated separately and then combined under conditions where there is no or substantially no change in the temperature of the combined stream and the parent streams. In dual stream embodiments of the systems of this invention, the compositions of these two streams can be designed to meet the design and output specifications as is well known to ordinary artisan. These design parameters can be used by an ordinary artisan to construct a system of this invention meeting the design goal and desired performance standards.

This allows for expansion to occur in the turbines at higher temperatures and therefore increases the total useful power produced per unit of weight of working solution fluid passing through the turbine sub-system.

Figure 2:
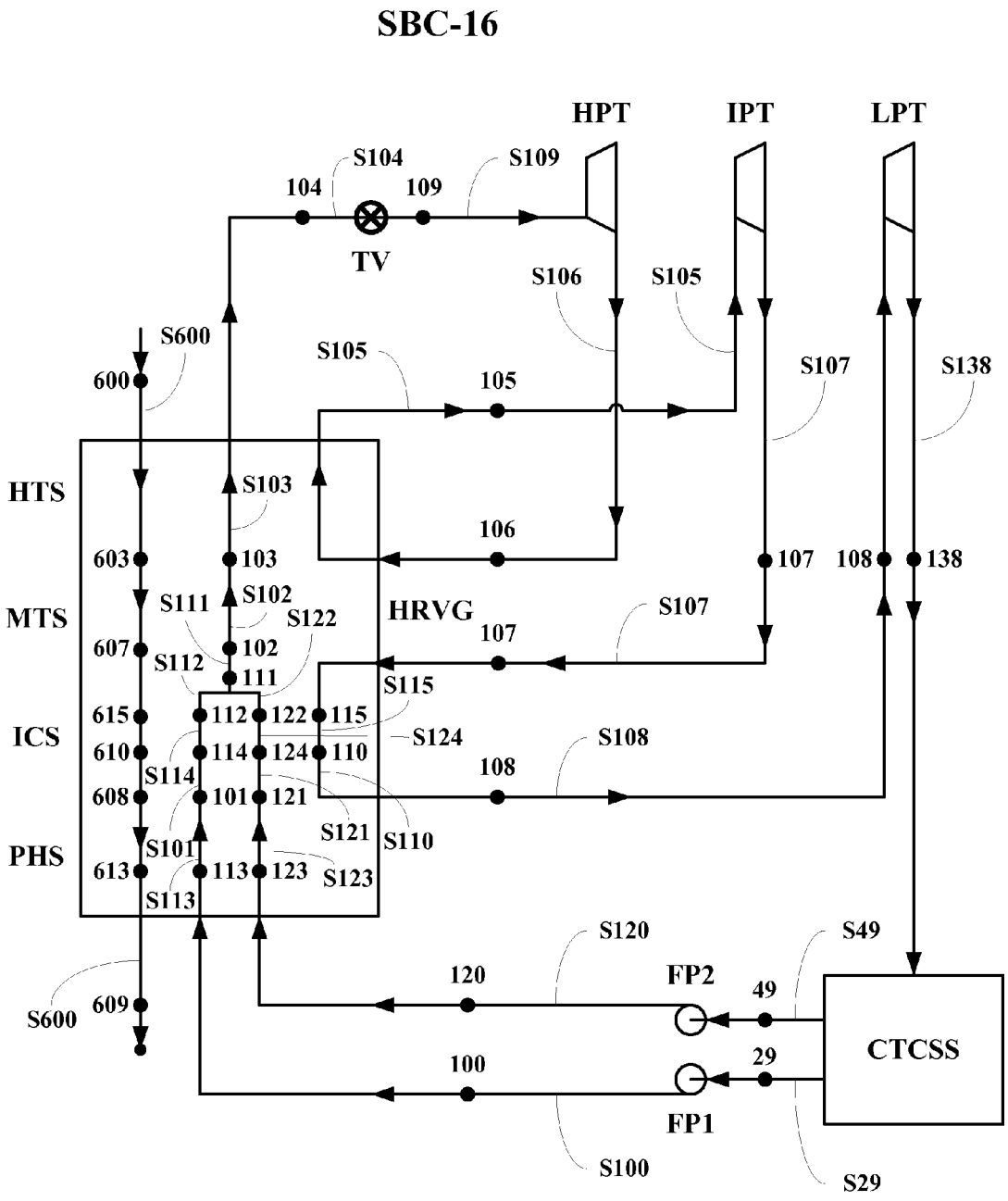
FIG. 2 depicts another embodiment of a system of this invention.

In an alternate, more elaborate and complicated embodiment of the systems of the invention, designated SBC-16 and shown in FIG. 2, where the turbine sub-system includes an additional lower temperature turbine LPT. This alternate system only slightly out performs the SBC-17.

In this alternate embodiment, the working solution S108 exiting from the ICS of the HRVG, having the parameters as at the point 108, is sent into the low pressure turbine LPT, where it is expanded, producing additional power, and forms a spent working solution stream S138 having parameters as at a point 138.

The spent working solution stream 138 is then sent into the CTCSS.

Embodiments Condensation Thermal Compression Subsystem

In certain embodiments, the Condensation Thermal Compression Subsystem CTCSS is a simple condenser, cooled by air or water as opposed to more elaborate CTCSS, the pressure of the stream S138 having the parameters as at the point 138 would be defined by the required pressure of condensation of the chosen working fluid at the temperature of the cooling media in the condenser.

In embodiments of the system using more elaborate CTCSS, the stream S138 is sent into the CTCSS, where the remaining thermal energy potential of the stream S138 is used to provide for its own condensation at pressures that are substantially lower than the pressure that could be achieved in a simple condenser. As a result, the total rate of expansion of the working fluid is substantially increased, which results in the increased efficiency of the systems of this invention.

In addition, in the systems of this invention, the CTCSS splits the single stream of working solution stream S138 into two streams S29 and S49 having different compositions, which is a unique feature of this invention as described above.

Figure 3:
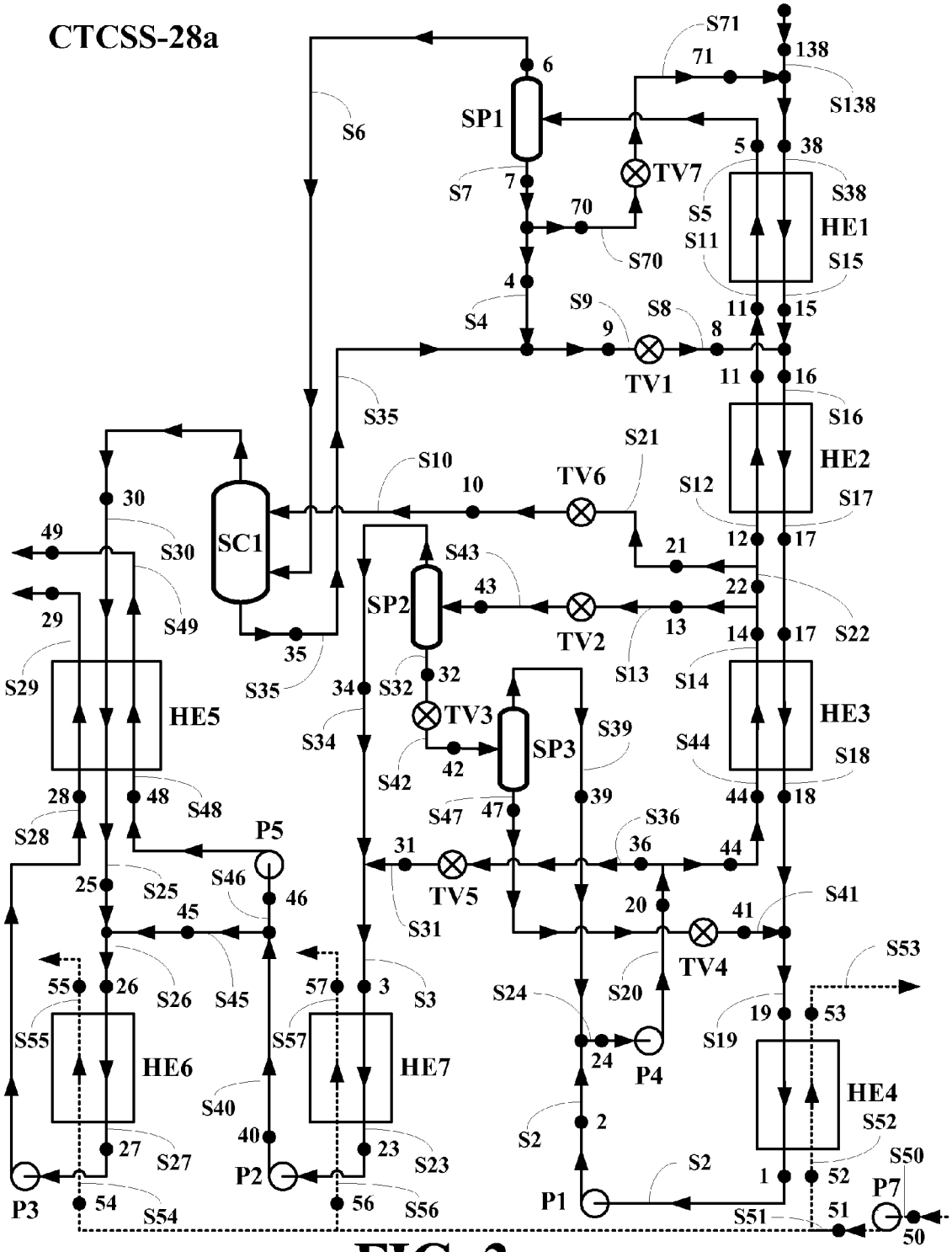
FIG. 3 depicts an embodiment of a condensation thermal compression sub-system (CTCSS) of this invention.

Referring FIG. 3, a embodiments of the Condensation Thermal Compression Subsystem CTCSS, generally CTCSS-28*a*, is shown in a flow diagram, where its components and operational feature are described.

The spent working solution stream S138 having the parameters as at the point 138 from either of the system embodiments SBC-17 or SBC-16, which, in most cases, is in a state of superheated vapor, is mixed with a lean liquid stream S71 having parameters as at a point 71 (see below). As a result of mixing, the composition of the new combined stream S38 having parameters as at a point 38 is leaner than that of stream S138 having the parameters as at the point 138. A flow rate of stream S71 is chosen in such a way that, as a result of the mixing, the resultant stream S38 having the parameters as at the point 38 corresponds to a state of saturated vapor.

In the case that the vapor stream S138 having the parameters as at the point 138 is already in a state of saturated vapor, the flow rate of the stream S71 is equal to 0 and the parameters at points 138 and 38 are the same.

The stream S38 now enters into a first heat exchange unit HE1, where it is partially condensed, releasing heat for in heat exchange process 11-5 or 38-15 (see below) to form a cooled stream S15 having parameters as at a point 15.

At this point, an additional lean liquid stream S8 having parameters as at a point 8 (see below) is mixed with the stream S15 to form a combined stream S16 parameters as at a point 16. The stream S16 has a larger flow rate than the flow rate of the stream S15. The composition of the stream S16 having the parameters as at the point 16 is substantially leaner than the stream S15 having the parameters as at the point 15.

The stream S16 now enters into a second heat exchange unit HE2, where the stream S16 cooled and condensed, releasing heat in a heat exchange process 12-11 or 16-17 (see below) to form a further cooled stream S17 having parameters as at point 17, corresponding to a state of a vapor-liquid mixture.

Thereafter, the stream S17 enters into a third heat exchanger HE3, where it is yet further cooled and condensed, providing heat for heat exchange process 44-14 or 17-18 (see below) to form a stream S18 having parameters as at a point 18.

The stream S18 is then mixed with a lean liquid stream S41 having parameters as at a point 41 to form a stream S19 having parameters as at a point 19. The composition of stream S19 is designated as a "basic solution" composition. The basic solution stream S19 having the parameters as at the point 19 is chosen in such a way that it can be fully condensed by an external coolant stream (air or water) at the available temperature of the external coolant stream.

The stream S19 now passes through a fourth and final low pressure condenser HE4, where it is cooled in counter-flow with the external coolant stream S52 having parameter as at a point 52 in a heat exchange process 52-53 to form a spent external coolant stream S53 having parameter as at a point 53 and fully condensed stream S1 having parameters as at a point 1.

The stream S1 is now sent into a first circulating pump P1, where it is pumped to an intermediate pressure to form a higher pressure basic solution stream S2 having parameters as at a point 2, corresponding to a state of subcooled liquid.

Thereafter, the stream S2 is mixed with a rich vapor stream S39 having parameters as at a point 39 (see below) to form a stream S24 having parameters as at a point 24, referred to as an enriched basic solution. The throttling of the stream S32 to an intermediate pressure followed by its separation in the separator SP3 to form the rich vapor stream S39, which is then used to enrich the basic solution stream S2 to form the enriched basic solution stream S24 is a unique feature of the present CTCSS.

The stream S24 is now sent into a second circulating pump P4, where it is pumped to a required elevated pressure to form a stream S20 having parameters as at a point 20, corresponding to a state of subcooled liquid. The pressure of the stream S20 having the parameters as at the point 20 is higher than the pressure at which the working solution streams circulating through the turbine subsystem of the SBC systems could be condensed by an external coolant stream at the available temperature.

Thereafter, the stream S20 is divided into two substreams S36 and S44 having parameters as at points 36 and 44, respectively. The stream S44 represents a substantially greater part of a flow of the stream S20, where the term substantially greater part means that the stream S44 comprises at least 60% of the stream S20. In other embodiments, the stream S44 comprises at least 70% of the stream S20. In other embodiments, the stream S44 comprises at least 80% of the stream S20. In other embodiments, the stream S44 comprises at least 90% of the stream S20.

The stream S44 now enters into the heat exchange unit HE3, where it is heated in counterflow by the condensing stream S17 in the heat exchange process 44-14 and 17-18 to form a stream S14 having parameters as at a point 14, corresponding to a state of saturated or slightly subcooled liquid (see above).

The stream S14 is now divided into two substreams S22 and S13 having parameters as at point 22 and 13, respectively.

The stream S22 is then further divided into two more substreams S12 and S21 having parameters as at points 12 and 21, respectively.

The stream S12, which is an enriched basic solution stream, having the parameters as at the point 12 is now sent into the heat exchange unit HE2, where it is heated and partially vaporized in counterflow with the condensing stream S16 in the heat exchange process 16-17 and 12-11 to form a stream S11 having parameters as at a point 11, corresponding to a state of vapor-liquid mixture (see above).

The stream S11 now enters into the heat exchange unit HE1, where it is further heated and vaporized in counterflow by the stream S38 in the heat exchange process 38-15 and 11-5 (see above) to form a stream S5 having parameters as at a point 5, corresponding to a state of vapor-liquid mixture.

The stream S5 is now sent into a gravity separator/flash tank SP1, where it is separated into a saturated vapor stream S6 having parameters as at a point 6 and a saturated liquid stream S7 having parameters as at s point 7.

The composition of the saturated vapor stream S6 having the parameters as at the point 6 is substantially richer than the composition of the stream S5 having the parameters as at the point 5, and likewise substantially richer than the composition of the working solution circulating through the turbines of the SBC system—the composition of the working solution stream S138 having the parameters as at the point 138.

The composition of the saturated liquid stream S7 having the parameters as at the point 7 is, to the contrary, substantially leaner than the composition of the stream S5 having the parameters as at the point 5.

The lean saturated liquid stream S7 having the parameters as at the point 7 is now divided into two substreams S70 and S4 having parameters as at points 70 and 4, respectively.

The stream S70 is now sent into a throttle value TV7, where its pressure is reduced to a pressure equal to the pressure of the working solution stream S138 having the parameters as at the point 138 to form a stream S71 having the parameters as at a point 71. The stream S71 is now mixed with the stream S138, reducing its temperature and forming the saturated vapor stream S38 having parameters as at the point 38 (see above).

Meanwhile, the saturated vapor stream S6 having the parameters as at the point 6 (coming from the gravity separator SP1) is sent into a lower port LP of a scrubber (direct contact heat exchanger) SC1.

At the same time, the stream S21 (see above) passes through a throttle valve TV6, where its pressure is slightly reduced to form a stream S10 having parameters as at a point 10. The stream S10 is now sent into an upper port UP of the scrubber SC1.

The vapor stream S6 and the liquid stream S10 move through the scrubber SC1 in counterflow to each other. As a result of interaction between streams S6 and S10, a further-enriched saturated vapor stream S30 having parameters as at a point 30 is removed from a top port TP of the scrubber SC1. At the same time, a saturated liquid stream S35 having parameters as at a point 35 is removed from a bottom port of the scrubber SC1.

The stream S35 is now combined with the stream S4, forming a lean liquid stream S9 having parameters as at a point 9. The stream S9 is then sent into a throttle value TV1, where its pressure is reduced to form a pressure adjusted stream S8 having parameters as at a point 8. The pressure and temperature of the stream S8 having the parameters as at the point 8 are equal to the pressure and temperature of the stream S15 having the parameters as at the point 15 (see above). The streams S8 and S15 are then combined to form the stream S16 (see above).

At the same time, the stream S13 (see above) is sent into a throttle valve TV2, where its pressure is reduced to an intermediate pressure to form a stream S43 having parameters as at a point 43, corresponding to a state of a liquid-vapor mixture.

The stream S43 now enters into a second gravity separator SP2, where it is separated into a saturated vapor stream S34 having parameters as at a point 34, and a saturated liquid stream S32 having parameters as at a point 32.

Concurrently, the enriched basic solution stream S36 having the parameters as at the point 36 (see above) is sent into a throttle valve TV5, where its pressure is reduced to a pressures equal to a pressure of the stream S34 having parameters as at the point 34 to form a stream S31 having parameters as at a point 31, corresponding to a state of liquid-vapor mixture.

The stream S31 is now combined with the stream S34 to form a stream S3 having parameters as at a point 3.

The pressure and composition of the stream S3 having the parameter as at the point 3 are such that stream S3 can be fully condensed with the available external coolant.

The stream S3 is now sent into an intermediate pressure condenser HE7, where it is cooled in counterflow and fully condensed by an external coolant stream S56 in a heat exchange process 56-57 and 3-23 to form S23 having parameters as at a point 23. A flow rate and composition of the stream S23 are such that if it would be combined with the vapor stream S30 having with parameters as at a point 30, it would form a stream with the same composition and flow rate as the incoming working solution stream S138 having the parameters as at the point 138.

Meanwhile, the stream S30 exiting from the top port TP of the scrubber SC1 is sent though a fifth heat exchange unit HE5, where it is cooled and partially condensed to form a stream S25 having parameters as at a point 25.

At the same time, the stream S23 is sent into a circulating pump P2, where its pressure is increased to a pressure equal to the pressure of the stream S25 having the parameter as at the point 25 to form a stream S40 having parameters as at a point 40.

Stream 40 is now divided into two substreams, with parameters as at points 45 and 46.

The stream S45 is now combined with the stream S25 to form a stream S26 having parameters as at a point 26. The composition of the stream S26 having the parameters as at the point 26 is equal to the composition of the rich working solution stream S29 that will be sent into the SBC systems and, after pressurization, into the HRVG.

Thereafter, the stream S26 is sent into a high pressure final condenser HE6, where it is cooled and fully condensed in counterflow by an external coolant stream S54 in a heat exchange process 54-55 and 26-27 to form a stream S27 having the parameters as at the point 27.

Stream 27 is then sent into a booster pump, P3, where its pressure is increased, obtaining parameters as at point 28, corresponding to a state of subcooled liquid.

The rich solution stream S28 now passes through the heat exchange unit HE5, where it is heated by the condensing stream S30 in the heat exchange process 30-25 (see above) to form the stream S29 having the parameters as at the point 29. The stream S29 is now sent into the SBC systems.

Meanwhile, the stream S46 is sent into a booster pump P5, where its pressure is increased to an elevated pressure to form a stream S48 having parameters as at a point 48. The stream S48 is then sent into the heat exchange unit HE5, where it is heated in counterflow by the condensing stream S30 in the heat exchange process 30-25 (see above) to form the stream S49 having the parameters as at the point 49. The stream S49 is now sent into the SBC systems.

Meanwhile, the liquid stream S32 having the parameters as at the point 32 exiting the separator SP2 is sent into a throttle valve TV3, where its pressure is reduced to form a stream S42 having parameters as at a point 42, which corresponds to a state of vapor-liquid mixture.

The stream S42 is now sent into the gravity separator SP3, where it is separated into a saturated vapor stream S39 having parameters as at a point 39 and a saturated liquid stream S47 having parameters as at a point 47.

The stream S39 is now mixed with the stream S2 (see above) is fully absorbed by the stream S2 (which is subcooled liquid basic solution stream) to form the enriched solution stream S24 having parameters as at the point 24 (see above).

The liquid stream S47 exiting the separator SP3 meanwhile is sent into a throttle valve TV4, where its pressure is reduced to form S41 having parameters as at a point 41. The stream S41 is then combined with the stream S18 to form a basic solution stream S19 having parameters as at a point 19 (see above).

In the present embodiment, an external coolant stream S50 (coolant; air and/or water) having initial parameters as at a point 50 is sent into a pump P7, where its pressure is increased to form an higher pressure stream S51 having parameters as at a point 51. In the case that the coolant is air, the pump P7 is a fan F.

The stream S51 is then divided into three parallel streams S52, S54 and S56 having parameters as at point 52, 54 and 56, respectively. The streams S52, S54 and S56 are then sent into heat exchangers HE4, HE7 and HE6, respectively, (as described above). Of course, it should be recognized that the stream S52, S54 and S56 may be derived from separate coolant stream and may be separately pressurized.

The throttling of the liquid stream S32, and then the sending of the resultant stream S42 into the separator SP3 in order to produce a vapor stream S39 having parameters as at a point 39 allows for the enrichment of the basic solution, which in its turn allows for the initial basic solution to be made leaner. As a result, the pressure at which the basic solution can be condensed becomes lower, and, therefore, the back pressure to which the working fluid can be expanded in the turbines becomes lower as well, increasing the output and efficiency of the system.

The embodiment CTCSS-28*a* also provides for the division of the exiting working fluid into two substreams, which allows the reduction of the average temperature at which the working fluid is converted from liquid to vapor in the HRVG (as described above).

Components

In the standard embodiment of a bottoming cycle for combined cycle units, the boiler (i.e., HRVG or HRSG) generally comprises a heat exchanger through which tubes pass in an "S" or serpentine-like pattern. As a result, heat transfer from the flue gas to the working fluid occurs in a counter-cross flow. Tubes through which the working fluid moves through the HRVG or HRSG form rows.

In the systems of this invention, in the preheater section (PHS) of the HRVG, there are two upcoming streams or fluid flows, a rich solution stream S100 and a lean solution stream S120. In certain embodiments of the PHS of the HRVG, each row of tubes comprises separate tubes for the rich solution stream and separate tubes for the lean solution stream, placed intermittently in the row.

In the intercooler section (ICS) of the HRVG, there are two subsections; the lower temperature portion of the ICS, where the rich and lean solution streams move in separate tubes, and the higher temperature portion, where the rich and lean solution streams have been combined into single stream in combined tubes. In addition, the ICS of the HRVG also contains the tubes through which the intercooled stream S107 flows.

Therefore, each row of tubes in the lower temperature ICS comprises three kinds of tubes: (1) one set of tubes through which the higher pressure, rich solution stream S100 flows counter-crosswise to the flow of flue gas stream S600, (2) one set of tubes through which the higher pressure, lean solution stream S120 flows counter-crosswise to the flow of flue gas stream S600, and (3) one set of tubes though which the intercooling working fluid stream S107 moves parallel-crosswise to the flow of the flue gas S600.

In the higher temperature portion of the ICS of the HRVG, each row of tubes comprises two sets of tubes: high pressure tubes in which the working solution stream S111 flows counter-crosswise to the flow of flue gas S600, and low pressure tubes through which the intercooling working solution stream S107 flows parallel-crosswise to the flow of the flue gas S600.

In the CTCSS, the heat exchange units HE1, HE2, HE3 and HE4 may be arranged as a single combined heat exchanger with four sections through which the condensing stream passes through the shell and the upcoming heated streams move through their respective tube coils or flow passages. Moreover, the heat exchange units HE5 and HE6 of the CTCSS may also be arranged as a single heat exchanger with two sections.

Comparison of Performance of Embodiments SBC-17 and SBC-16

A comparison of the performance of the SBC-17 and SBC-16 are presented in Table I and Table II. Table I tabulates the performance characteristics of SBC-17 using GE 9FB 53.5F 0.91 turbines, while Table II tabulates the performance characteristics of SBC-16 using GE 9FB 53.5F 0.91 turbines.

TABLE I

SBC-17/CTCSS K28a
Plant Performance Summary
Working Fluid: Ammonia/Water
SBC-17 GE 9FB 53.5F 0.91

| | | | | |
|---|---|---|---|---|
| Heat in | 447,199.80 | kW | 1,325.39 | Btu/lb |
| Heat rejected | 262,630.03 | kW | 778.37 | Btu/lb |
| Turbine enthalpy Drops | 190,701.07 | kW | 565.19 | Btu/lb |
| Gross Generator Power | 188,794.05 | kW | 559.54 | Btu/lb |
| Process Pumps (−17.94) | −6,070.81 | kW | −17.99 | Btu/lb |
| Cycle Output | 182,723.24 | kW | 541.54 | Btu/lb |
| Other Pumps and Fans (−7.13) | −2,383.10 | kW | −7.06 | Btu/lb |
| Net Output | 180,340.14 | kW | 534.48 | Btu/lb |
| Gross Generator Power | 188,794.05 | kW | 559.54 | Btu/lb |
| Cycle Output | 182,723.24 | kW | 541.54 | Btu/lb |
| Net Electrical Output | 180,340.14 | kW | 534.48 | Btu/lb |
| Net Electrical Efficiency | 40.33% | | | |
| Second Law Limit | 49.79% | | | |
| 2nd Law Electrical Efficiency | 80.99% | | | |
| LHV Heat Avail (@ 59 F.) | 464,234.81 | kW | 1,375.87 | Btu/lb |
| LHV Electrical Efficiency | 38.85% | | | |

Overall Heat Balance (Btu/lb)
Heat In: Source + pumps = 1,325.39 + 17.94 = 1,343.33
Heat Out: Turbines + condenser = 565.19 + 778.37 + 0.00 = 1,343.56

TABLE II

SBC-16/CTCSS K28a
Plant Performance Summary
Working Fluid: Ammonia/Water
SBC-16 GE 9FB 53.5 F

| | | | | |
|---|---|---|---|---|
| Heat In | 448,521.96 | kW | 1,274.90 | Btu/lb |
| Heat Rejected | 262,897.03 | kW | 747.27 | Btu/lb |
| Turbine enthalpy Drops | 191,929.76 | kW | 545.55 | Btu/lb |
| Gross Generator Power | 190,010.47 | kW | 540.09 | Btu/lb |
| Process Pumps (−17.79) | −6,275.91 | kW | −17.84 | Btu/lb |
| Cycle Output | 183,734.55 | kW | 522.25 | Btu/lb |
| Other Pumps and Fans (−6.87) | −2,392.30 | kW | −6.80 | Btu/lb |
| Net Output | 181,342.25 | kW | 515.45 | Btu/lb |
| Gross Generator Power | 190,010.47 | kW | 540.09 | Btu/lb |
| Cycle Output | 183,734.55 | kW | 522.25 | Btu/lb |
| Net Electrical Output | 181,342.25 | kW | 515.45 | Btu/lb |
| Net Electrical Efficiency | 40.43% | | | |
| Second Law Limit | 49.67% | | | |
| 2nd Law Electrical Efficiency | 81.40% | | | |
| LHV Heat Avail (@ 59 F.) | 464,234.81 | kW | 1,319.56 | Btu/lb |
| LHV Electrical Efficiency | 39.06% | | | |

Overall Heat Balance (Btu/lb)
Heat In: Source + pumps = 1,274.90 + 17.79 = 1,292.69
Heat Out: Turbines + condenser = 545.55 + 747.27 + 0.00 = 1,292.82

Performance

The systems of this invention provides for superior efficiency as compared to the prior art (prior SBC & CTCSS patents of the inventor U.S. Pat. Nos. 7,043,919 and 7,197,876) and can attain very high efficiencies. The computations shows that the 2nd Law Efficiency of the systems of the invention exceeds 80% (80.99% for SBC-17 and 81.40% for SBC-16). Thermal efficiency of the bottoming cycle embodiments of the system of this invention exceeds 40% as compared with 35% for a Rankine cycle.

As a result, the overall efficiency of a combined cycle that utilized the systems of this invention (assuming current, conventional gas turbines) is as high as 63.5% as compared with an overall efficiency of a combined cycle with a Rankine bottoming cycle of at best 59%.

Point Parameter Comparison of Embodiments SBC-17 and SBC-16

Table III tabulates the parameters of the SBC-17 embodiment of the system of this invention, while Table IV tabulates the parameters of the SBC-16 embodiment of the system of this invention.

TABLE III

SBC-17/CTCSS K28a
System Point Summary
Working Fluid: Ammonia/Water
SBC-17 GE 9FB 53.5 F. 0.91

| Working Fluid | | | | | | | | | | |
|---|---|---|---|---|---|---|---|---|---|---|
| Pt. | X lb/lb | T ° F. | P psia | H Btu/lb | S Btu/lb-R | Ex Btu/lb | G * rel G/G = 1 | G * abs lb/h | Ph. | Wetness lb/lb/T ° F. |
| 1 | 0.5253 | 60.59 | 38.116 | −77.6134 | 0.0024 | 0.9102 | 6.40627 | 7,380,437 | Mix | 1 |
| 2 | 0.5253 | 60.68 | 49.106 | −77.4807 | 0.0026 | 0.9501 | 6.40627 | 7,380,437 | Liq | −12.63° F. |
| 3 | 0.6882 | 86.84 | 68.919 | 149.7507 | 0.4051 | 20.1360 | 0.50701 | 584,106 | Mix | 0.6838 |
| 4 | 0.3183 | 181.09 | 99.816 | 65.8367 | 0.2415 | 19.4376 | 0.82556 | 951,102 | Mix | 1 |
| 5 | 0.5341 | 181.09 | 99.816 | 265.2364 | 0.5810 | 43.7104 | 1.36455 | 1,572,055 | Mix | 0.6582 |
| 6 | 0.9494 | 181.09 | 99.816 | 649.1408 | 1.2347 | 90.4429 | 0.46647 | 537,399 | Mix | 0 |
| 7 | 0.3183 | 181.09 | 99.816 | 65.8367 | 0.2415 | 19.4376 | 0.89809 | 1,034,655 | Mix | 1 |
| 8 | 0.3187 | 138.69 | 38.416 | 65.6029 | 0.2452 | 17.2754 | 0.98538 | 1,135,223 | Mix | 0.9355 |
| 9 | 0.3187 | 180.93 | 99.816 | 65.6030 | 0.2412 | 19.3665 | 0.98538 | 1,135,223 | Mix | 1 |
| 10 | 0.5341 | 111.22 | 99.316 | −18.3940 | 0.1098 | 4.4754 | 0.18634 | 214,680 | Mix | 0.9966 |
| 11 | 0.5341 | 132.55 | 101.316 | 84.9736 | 0.2876 | 15.6423 | 1.36455 | 1,572,055 | Mix | 0.861 |
| 12 | 0.5341 | 112.96 | 102.816 | −18.3940 | 0.1098 | 4.4907 | 1.36455 | 1,572,055 | Mix | 1 |
| 13 | 0.5341 | 112.96 | 102.816 | −18.3940 | 0.1098 | 4.4907 | 4.63800 | 5,343,278 | Mix | 1 |

TABLE III-continued

SBC-17/CTCSS K28a
System Point Summary
Working Fluid: Ammonia/Water
SBC-17 GE 9FB 53.5 F. 0.91

| | | | | | | | | | | |
|---|---|---|---|---|---|---|---|---|---|---|
| 14 | 0.5341 | 112.96 | 102.816 | −18.3940 | 0.1098 | 4.4907 | 6.18890 | 7,130,013 | Mix | 1 |
| 15 | 0.8047 | 138.69 | 38.416 | 501.6982 | 1.0687 | 28.4139 | 1.07252 | 1,235,618 | Mix | 0.2163 |
| 16 | 0.5720 | 138.69 | 38.416 | 292.8840 | 0.6744 | 23.0805 | 2.05791 | 2,370,841 | Mix | 0.5606 |
| 17 | 0.5720 | 118.11 | 38.266 | 224.3432 | 0.5580 | 14.8966 | 2.05791 | 2,370,841 | Mix | 0.6268 |
| 18 | 0.5720 | 79.80 | 38.166 | 83.9832 | 0.3064 | 5.0668 | 2.05791 | 2,370,841 | Mix | 0.7785 |
| 19 | 0.5253 | 71.49 | 38.166 | −12.4770 | 0.1264 | 1.7592 | 6.40627 | 7,380,437 | Mix | 0.9157 |
| 20 | 0.5341 | 71.40 | 105.816 | −65.0659 | 0.0252 | 1.7106 | 6.52713 | 7,519,682 | Liq | −43.36° F. |
| 21 | 0.5341 | 112.96 | 102.816 | −18.3940 | 0.1098 | 4.4907 | 0.18634 | 214,680 | Mix | 1 |
| 22 | 0.5341 | 112.96 | 102.816 | −18.3940 | 0.1098 | 4.4907 | 1.55090 | 1,786,735 | Mix | 1 |
| 23 | 0.6882 | 60.59 | 68.869 | −57.7562 | 0.0143 | 15.3358 | 0.50701 | 584,106 | Mix | 1 |
| 24 | 0.5341 | 71.22 | 49.106 | −65.3953 | 0.0249 | 1.5009 | 6.52713 | 7,519,682 | Liq | −0.02° F. |
| 25 | 0.9962 | 66.11 | 99.116 | 543.3794 | 1.0572 | 76.9414 | 0.49299 | 567,959 | Mix | 0.0214 |
| 26 | 0.9100 | 77.22 | 99.116 | 375.2771 | 0.7659 | 59.5174 | 0.68447 | 788,554 | Mix | 0.3149 |
| 27 | 0.9100 | 60.59 | 99.066 | 1.4420 | 0.0536 | 55.1598 | 0.68447 | 788,554 | Mix | 1 |
| 28 | 0.9100 | 61.11 | 243.226 | 2.2971 | 0.0540 | 55.8125 | 0.68447 | 788,554 | Liq | −54.5° F. |
| 29 | 0.9100 | 79.78 | 240.226 | 23.4930 | 0.0940 | 56.2554 | 0.68447 | 788,554 | Liq | −34.98° F. |
| 30 | 0.9962 | 112.22 | 99.316 | 586.3851 | 1.1356 | 79.2986 | 0.49299 | 567,959 | Mix | 0 |
| 31 | 0.5341 | 71.48 | 68.919 | −65.0659 | 0.0254 | 1.5792 | 0.33824 | 389,669 | Liq | −17.95° F. |
| 32 | 0.5166 | 93.75 | 68.919 | −41.0012 | 0.0710 | 1.9090 | 4.46923 | 5,148,841 | Mix | 1 |
| 34 | 0.9970 | 93.75 | 68.919 | 580.2629 | 1.1650 | 57.8910 | 0.16877 | 194,437 | Mix | 0 |
| 35 | 0.3209 | 180.09 | 99.816 | 64.3953 | 0.2396 | 19.0009 | 0.15982 | 184,121 | Mix | 1 |
| 36 | 0.5341 | 71.40 | 105.816 | −65.0659 | 0.0252 | 1.7106 | 0.33824 | 389,669 | Liq | −43.36° F. |
| 38 | 0.8047 | 186.09 | 38.566 | 731.0433 | 1.4350 | 67.7676 | 1.07252 | 1,235,618 | Vap | 0° F. |
| 39 | 0.9974 | 78.78 | 49.106 | 575.1564 | 1.1936 | 37.9735 | 0.12087 | 139,245 | Mix | 0 |
| 40 | 0.6882 | 60.73 | 99.116 | −57.5298 | 0.0145 | 15.4547 | 0.50701 | 584,106 | Liq | −20.1° F. |
| 41 | 0.5032 | 68.34 | 38.166 | −58.1277 | 0.0408 | 0.3820 | 4.34836 | 5,009,595 | Mix | 0.9818 |
| 42 | 0.5166 | 78.78 | 49.106 | −41.0012 | 0.0717 | 1.5686 | 4.46923 | 5,148,841 | Mix | 0.973 |
| 43 | 0.5341 | 93.75 | 68.919 | −18.3940 | 0.1108 | 3.9461 | 4.63800 | 5,343,278 | Mix | 0.9636 |
| 44 | 0.5341 | 71.40 | 105.816 | −65.0659 | 0.0252 | 1.7106 | 6.18890 | 7,130,013 | Liq | −43.36° F. |
| 45 | 0.6882 | 60.73 | 99.116 | −57.5298 | 0.0145 | 15.4547 | 0.19148 | 220,595 | Liq | −20.1° F. |
| 46 | 0.6882 | 60.73 | 99.116 | −57.5298 | 0.0145 | 15.4547 | 0.31553 | 363,511 | Liq | −20.1° F. |
| 47 | 0.5032 | 78.78 | 49.106 | −58.1277 | 0.0405 | 0.5567 | 4.34836 | 5,009,595 | Mix | 1 |
| 48 | 0.6882 | 61.09 | 243.226 | −56.7999 | 0.0148 | 16.0201 | 0.31553 | 363,511 | Liq | −78.62° F. |
| 49 | 0.6882 | 79.78 | 240.226 | −35.5864 | 0.0549 | 16.4644 | 0.31553 | 363,511 | Liq | −59° F. |
| 70 | 0.3183 | 181.09 | 99.816 | 65.8367 | 0.2415 | 19.4376 | 0.07252 | 83,553 | Mix | 1 |
| 71 | 0.3183 | 139.00 | 38.566 | 65.8368 | 0.2455 | 17.3624 | 0.07252 | 83,553 | Mix | 0.9357 |
| 86 | 0.9962 | 66.11 | 99.116 | 543.3794 | 1.0572 | 76.9414 | 0.15564 | 179,310 | Mix | 0.0214 |
| 87 | 0.9962 | 66.11 | 99.116 | 543.3794 | 1.0572 | 76.9414 | 0.33735 | 388,648 | Mix | 0.0214 |
| 88 | 0.9962 | 112.22 | 99.316 | 586.3851 | 1.1356 | 79.2986 | 0.15564 | 179,310 | Mix | 0 |
| 89 | 0.9962 | 112.22 | 99.316 | 586.3851 | 1.1356 | 79.2986 | 0.33735 | 388,648 | Mix | 0 |
| 100 | 0.9100 | 88.64 | 3,060.000 | 38.3703 | 0.0975 | 69.2850 | 0.68447 | 788,554 | Liq | −286.26° F. |
| 101 | 0.9100 | 270.17 | 3,025.000 | 258.2804 | 0.4425 | 110.2720 | 0.68447 | 788,554 | Liq | −131.17° F. |
| 102 | 0.8400 | 572.86 | 2,975.000 | 802.2562 | 1.0834 | 321.5111 | 1.00000 | 1,152,065 | Pcr | |
| 103 | 0.8400 | 681.71 | 2,935.000 | 908.2607 | 1.1824 | 376.1672 | 1.00000 | 1,152,065 | Pcr | |
| 104 | 0.8400 | 1,087.82 | 2,900.000 | 1,242.9682 | 1.4350 | 579.8598 | 1.00000 | 1,152,065 | Pcr | |
| 105 | 0.8400 | 1,087.00 | 400.447 | 1,276.7793 | 1.6821 | 485.5114 | 1.00000 | 1,152,065 | Vap | 779.1° F. |
| 106 | 0.8400 | 681.71 | 421.523 | 989.5644 | 1.4616 | 312.6596 | 1.00000 | 1,152,065 | Pcr | |
| 107 | 0.8400 | 624.86 | 40.596 | 964.9940 | 1.7075 | 160.5648 | 1.00000 | 1,152,065 | Pcr | |
| 108 | 0.8400 | 307.19 | 38.566 | 779.2874 | 1.5115 | 76.5033 | 1.00000 | 1,152,065 | Vap | 128.8° F. |
| 109 | 0.8400 | 1,087.00 | 2,850.000 | 1,242.9682 | 1.4370 | 578.8525 | 1.00000 | 1,152,065 | Pcr | |
| 110 | 0.8400 | 354.07 | 38.866 | 805.2671 | 1.5435 | 85.8892 | 1.00000 | 1,152,065 | Vap | 175.3° F. |
| 111 | 0.8400 | 402.03 | 3,002.031 | 495.8202 | 0.7528 | 186.5601 | 1.00000 | 1,152,065 | Pcr | |
| 112 | 0.9100 | 402.03 | 3,002.031 | 543.2084 | 0.7978 | 210.9407 | 0.68447 | 788,554 | Pcr | |
| 113 | 0.9100 | 98.58 | 3,065.000 | 49.4946 | 0.1176 | 70.0021 | 0.68447 | 788,554 | Liq | −277.73° F. |
| 114 | 0.9100 | 324.07 | 3,018.021 | 344.8500 | 0.5568 | 137.5598 | 0.68447 | 788,554 | Liq | −12.59° F. |
| 115 | 0.8400 | 457.21 | 39.493 | 864.0312 | 1.6096 | 110.3559 | 1.00000 | 1,152,065 | Vap | 277.7° F. |
| 120 | 0.6882 | 85.67 | 3,060.000 | −22.7316 | 0.0580 | 27.7107 | 0.31553 | 363,511 | Liq | −344.44° F. |
| 121 | 0.6882 | 270.17 | 3,025.000 | 195.9425 | 0.4026 | 67.6392 | 0.31553 | 363,511 | Liq | −141.39° F. |
| 122 | 0.6882 | 402.03 | 3,002.031 | 393.0224 | 0.6496 | 136.6015 | 0.31553 | 363,511 | Liq | −51.23° F. |
| 123 | 0.6882 | 98.58 | 3,065.000 | −8.1170 | 0.0844 | 28.6170 | 0.31553 | 363,511 | Liq | −351.86° F. |
| 124 | 0.6882 | 324.07 | 3,018.021 | 267.7552 | 0.4975 | 90.2164 | 0.31553 | 363,511 | Liq | −130.95° F. |
| 129 | 0.9100 | 79.78 | 240.226 | 23.4930 | 0.0940 | 56.2554 | 0.68447 | 788,554 | Liq | −34.98° F. |
| 138 | 0.8400 | 307.19 | 38.566 | 779.2874 | 1.5115 | 76.5033 | 1.00000 | 1,152,065 | Vap | 128.8° F. |
| 149 | 0.6882 | 79.78 | 240.226 | −35.5864 | 0.0549 | 16.4644 | 0.31553 | 363,511 | Liq | −59° F. |

| Pt. | X lb/lb | T ° F. | P psia | H Btu/lb | S Btu/lb-R | Ex Btu/lb | G rel G/G = 1 | G abs lb/h | Ph. | Wetness lb/lb/T ° F. |
|---|---|---|---|---|---|---|---|---|---|---|
| | | | | | Heat Source | | | | | |
| 600 | GAS | 1,187.00 | 16.137 | 371.0954 | 0.4677 | 149.2063 | 4.56506 | 5,259,240 | Vap | 1071.7° F. |
| 601 | GAS | 1,187.00 | 16.137 | 371.0954 | 0.4677 | 149.2063 | 2.45683 | 2,830,429 | Vap | 1071.7° F. |
| 602 | GAS | 1,187.00 | 16.137 | 371.0954 | 0.4677 | 149.2063 | 2.10822 | 2,428,811 | Vap | 1071.7° F. |
| 603 | GAS | 696.71 | 15.811 | 234.8599 | 0.3711 | 63.0732 | 4.56506 | 5,259,240 | Vap | 582.2° F. |
| 605 | GAS | 696.71 | 15.811 | 234.8599 | 0.3711 | 63.0732 | 2.45683 | 2,830,429 | Vap | 582.2° F. |

TABLE III-continued

SBC-17/CTCSS K28a
System Point Summary
Working Fluid: Ammonia/Water
SBC-17 GE 9FB 53.5 F. 0.91

| | | | | | | | | | | |
|---|---|---|---|---|---|---|---|---|---|---|
| 606 | GAS | 696.71 | 15.811 | 234.8599 | 0.3711 | 63.0732 | 2.10822 | 2,428,811 | Vap | 582.2° F. |
| 607 | GAS | 609.86 | 15.753 | 211.6391 | 0.3505 | 50.5453 | 4.56506 | 5,259,240 | Vap | 495.4° F. |
| 608 | GAS | 292.19 | 15.541 | 128.8496 | 0.2597 | 14.8498 | 4.56506 | 5,259,240 | Vap | 178.2° F. |
| 609 | GAS | 112.28 | 15.415 | 80.7625 | 0.1867 | 4.6460 | 4.56506 | 5,259,240 | Mix | 0.0023 |
| 610 | GAS | 339.07 | 15.565 | 140.8812 | 0.2751 | 18.8860 | 6.80817 | 7,843,457 | Vap | 225.1° F. |
| 611 | GAS | 609.86 | 15.753 | 211.6391 | 0.3505 | 50.5453 | 6.80817 | 7,843,457 | Vap | 495.4° F. |
| 612 | GAS | 292.19 | 15.541 | 128.8496 | 0.2597 | 14.8498 | 6.80817 | 7,843,457 | Vap | 178.2° F. |
| 613 | GAS | 113.68 | 15.422 | 83.4406 | 0.1913 | 4.9148 | 4.56506 | 5,259,240 | Vap | 0° F. |
| 615 | GAS | 438.63 | 15.629 | 166.6291 | 0.3052 | 29.0280 | 6.80817 | 7,843,457 | Vap | 324.5° F. |
| 616 | GAS | 112.28 | 15.415 | 80.7532 | 0.1867 | 4.6501 | 4.55532 | 5,248,023 | Mix | 0 |
| 617 | Water | 112.28 | 1.363 | 80.3505 | 0.1514 | 2.5639 | 0.00974 | 11,217 | Mix | 1 |
| 618 | GAS | 112.28 | 15.415 | 80.7532 | 0.1867 | 4.6501 | 4.55532 | 5,248,023 | Mix | 0 |
| 621 | GAS | 609.86 | 15.753 | 211.6391 | 0.3505 | 50.5453 | 2.24312 | 2,584,217 | Vap | 495.4° F. |
| 622 | GAS | 292.19 | 15.541 | 128.8496 | 0.2597 | 14.8498 | 2.24312 | 2,584,217 | Vap | 178.2° F. |
| | | | | | Coolant | | | | | |
| 50 | Water | 53.50 | 14.693 | 21.6278 | 0.0430 | 0.0723 | 61.9876 | 71,413,767 | Liq | −158.45° F. |
| 51 | Water | 53.59 | 24.693 | 21.7429 | 0.0431 | 0.1011 | 61.9876 | 71,413,767 | Liq | −185.77° F. |
| 52 | Water | 53.59 | 24.693 | 21.7429 | 0.0431 | 0.1011 | 32.3751 | 37,298,157 | Liq | −185.77° F. |
| 53 | Water | 66.49 | 14.693 | 34.6319 | 0.0680 | 0.0965 | 32.3751 | 37,298,157 | Liq | −145.46° F. |
| 54 | Water | 53.59 | 24.693 | 21.7429 | 0.0431 | 0.1011 | 25.0577 | 28,868,123 | Liq | −185.77° F. |
| 55 | Water | 63.81 | 14.693 | 31.9545 | 0.0629 | 0.0651 | 25.0577 | 28,868,123 | Liq | −148.14° F. |
| 56 | Water | 53.59 | 24.693 | 21.7429 | 0.0431 | 0.1011 | 4.55485 | 5,247,488 | Liq | −185.77° F. |
| 57 | Water | 76.70 | 14.693 | 44.8408 | 0.0872 | 0.3383 | 4.55485 | 5,247,488 | Liq | −135.25° F. |
| 58 | Water | 66.16 | 14.693 | 34.2997 | 0.0674 | 0.0919 | 61.9876 | 71,413,767 | Liq | −145.79° F. |
| 60 | Water | 0.00 | 14.693 | 33.4637 | 0.0000 | 0.0000 | 57.4328 | 66,166,280 | Mix | 0 |

TABLE IV

SBC-16/CTCSS K28a
System Point Summary
Working Fluid: Ammonia/Water
SBC-16 GE 9FB 53.5 F.

| Pt. | X lb/lb | T ° F. | P psia | H Btu/lb | S Btu/lb-R | Ex Btu/lb | G rel G/G = 1 | G abs lb/h | Ph. | Wetness lb/lb/T ° F. |
|---|---|---|---|---|---|---|---|---|---|---|
| | | | | | Working Fluid | | | | | |
| 1 | 0.5349 | 60.59 | 39.890 | −77.1821 | 0.0025 | 1.3525 | 6.32697 | 7,600,150 | Mix | 1 |
| 2 | 0.5349 | 60.68 | 50.184 | −77.0521 | 0.0027 | 1.3901 | 6.32697 | 7,600,150 | Liq | −11.48° F. |
| 3 | 0.6841 | 84.45 | 68.209 | 134.5771 | 0.3780 | 18.9955 | 0.50131 | 602,190 | Mix | 0.7051 |
| 4 | 0.3155 | 179.49 | 95.924 | 64.4458 | 0.2390 | 19.3477 | 0.80594 | 968,122 | Mix | 1 |
| 5 | 0.5428 | 179.49 | 95.924 | 274.1640 | 0.5977 | 44.0244 | 1.31137 | 1,575,256 | Mix | 0.6412 |
| 6 | 0.9490 | 179.49 | 95.924 | 648.8798 | 1.2386 | 88.1157 | 0.47057 | 565,265 | Mix | 0 |
| 7 | 0.3155 | 179.49 | 95.924 | 64.4458 | 0.2390 | 19.3477 | 0.84080 | 1,009,991 | Mix | 1 |
| 8 | 0.3159 | 140.82 | 40.190 | 64.2102 | 0.2420 | 17.5324 | 0.96253 | 1,156,221 | Mix | 0.9411 |
| 9 | 0.3159 | 179.33 | 95.924 | 64.2102 | 0.2387 | 19.2758 | 0.96253 | 1,156,221 | Mix | 1 |
| 10 | 0.5428 | 106.62 | 95.424 | −22.9718 | 0.1011 | 4.4426 | 0.18471 | 221,875 | Mix | 0.9965 |
| 11 | 0.5428 | 135.42 | 97.424 | 114.6323 | 0.3383 | 19.0182 | 1.31137 | 1,575,256 | Mix | 0.8172 |
| 12 | 0.5428 | 108.42 | 98.924 | −22.9718 | 0.1011 | 4.4582 | 1.31137 | 1,575,256 | Mix | 1 |
| 13 | 0.5428 | 108.42 | 98.924 | −22.9718 | 0.1011 | 4.4582 | 4.59563 | 5,520,414 | Mix | 1 |
| 14 | 0.5428 | 108.42 | 98.924 | −22.9718 | 0.1011 | 4.4582 | 6.09171 | 7,317,545 | Mix | 1 |
| 15 | 0.8223 | 140.82 | 40.190 | 519.0169 | 1.0969 | 31.1840 | 1.03486 | 1,243,100 | Mix | 0.1899 |
| 16 | 0.5783 | 140.82 | 40.190 | 299.8478 | 0.6850 | 24.6053 | 1.99739 | 2,399,321 | Mix | 0.5519 |
| 17 | 0.5783 | 113.57 | 40.040 | 209.5049 | 0.5312 | 14.0222 | 1.99739 | 2,399,321 | Mix | 0.6401 |
| 18 | 0.5783 | 78.90 | 39.940 | 79.4949 | 0.2970 | 5.4960 | 1.99739 | 2,399,321 | Mix | 0.7837 |
| 19 | 0.5349 | 70.52 | 39.940 | −15.8295 | 0.1193 | 2.0991 | 6.32697 | 7,600,150 | Mix | 0.9194 |
| 20 | 0.5428 | 70.49 | 101.924 | −65.6002 | 0.0234 | 2.1167 | 6.43718 | 7,732,542 | Liq | −39.78° F. |
| 21 | 0.5428 | 108.42 | 98.924 | −22.9718 | 0.1011 | 4.4582 | 0.18471 | 221,875 | Mix | 1 |
| 22 | 0.5428 | 108.42 | 98.924 | −22.9718 | 0.1011 | 4.4582 | 1.49607 | 1,797,131 | Mix | 1 |
| 23 | 0.6841 | 60.59 | 68.159 | −58.5412 | 0.0138 | 14.8149 | 0.50131 | 602,190 | Mix | 1 |
| 24 | 0.5428 | 70.32 | 50.184 | −65.9092 | 0.0232 | 1.9248 | 6.43718 | 7,732,542 | Liq | −0.02° F. |
| 25 | 0.9967 | 66.06 | 95.274 | 547.4365 | 1.0689 | 74.9371 | 0.49869 | 599,041 | Mix | 0.0157 |
| 26 | 0.8750 | 76.53 | 95.274 | 311.5862 | 0.6585 | 51.3753 | 0.81664 | 980,976 | Mix | 0.4197 |
| 27 | 0.8750 | 60.59 | 95.224 | −9.5830 | 0.0471 | 47.3390 | 0.81664 | 980,976 | Mix | 1 |
| 28 | 0.8750 | 61.06 | 232.688 | −8.7809 | 0.0475 | 47.9468 | 0.81664 | 980,976 | Liq | −54.26° F. |
| 29 | 0.8750 | 77.13 | 229.688 | 9.4597 | 0.0820 | 48.2811 | 0.81664 | 980,976 | Liq | −37.31° F. |
| 30 | 0.9967 | 107.62 | 95.424 | 584.0037 | 1.1357 | 76.8310 | 0.49869 | 599,041 | Mix | 0 |
| 31 | 0.5428 | 70.56 | 68.209 | −65.6002 | 0.0237 | 1.9960 | 0.34548 | 414,997 | Liq | −16.21° F. |
| 32 | 0.5269 | 90.60 | 68.209 | −44.0781 | 0.0648 | 2.1141 | 4.43980 | 5,333,221 | Mix | 1 |
| 34 | 0.9974 | 90.60 | 68.209 | 578.3596 | 1.1627 | 57.1947 | 0.15583 | 187,193 | Mix | 0 |

TABLE IV-continued

SBC-16/CTCSS K28a
System Point Summary
Working Fluid: Ammonia/Water
SBC-16 GE 9FB 53.5 F.

| Pt. | X lb/lb | T ° F. | P psia | H Btu/lb | S Btu/lb-R | Ex Btu/lb | G rel G/G = 1 | G abs lb/h | Ph. | Wetness lb/lb/T ° F. |
|---|---|---|---|---|---|---|---|---|---|---|
| 35 | 0.3181 | 178.49 | 95.924 | 62.9979 | 0.2370 | 18.9081 | 0.15659 | 188,099 | Mix | 1 |
| 36 | 0.5428 | 70.49 | 101.924 | −65.6002 | 0.0234 | 2.1167 | 0.34548 | 414,997 | Liq | −39.78° F. |
| 38 | 0.8223 | 184.49 | 40.340 | 721.1754 | 1.4199 | 65.8197 | 1.03486 | 1,243,100 | Vap | 0° F. |
| 39 | 0.9978 | 76.98 | 50.184 | 573.7660 | 1.1886 | 39.2012 | 0.11021 | 132,392 | Mix | 0 |
| 40 | 0.6841 | 60.72 | 95.274 | −58.3295 | 0.0140 | 14.9213 | 0.50131 | 602,190 | Liq | −18.39° F. |
| 41 | 0.5149 | 67.42 | 39.940 | −59.8059 | 0.0370 | 0.7244 | 4.32958 | 5,200,830 | Mix | 0.9831 |
| 42 | 0.5269 | 76.98 | 50.184 | −44.0781 | 0.0653 | 1.8260 | 4.43980 | 5,333,221 | Mix | 0.9752 |
| 43 | 0.5428 | 90.60 | 68.209 | −22.9718 | 0.1020 | 3.9818 | 4.59563 | 5,520,414 | Mix | 0.9661 |
| 44 | 0.5428 | 70.49 | 101.924 | −65.6002 | 0.0234 | 2.1167 | 6.09171 | 7,317,545 | Liq | −39.78° F. |
| 45 | 0.6841 | 60.72 | 95.274 | −58.3295 | 0.0140 | 14.9213 | 0.31795 | 381,935 | Liq | −18.39° F. |
| 46 | 0.6841 | 60.72 | 95.274 | −58.3295 | 0.0140 | 14.9213 | 0.18336 | 220,254 | Liq | −18.39° F. |
| 47 | 0.5149 | 76.98 | 50.184 | −59.8059 | 0.0367 | 0.8746 | 4.32958 | 5,200,830 | Mix | 1 |
| 48 | 0.6841 | 61.06 | 232.688 | −57.6311 | 0.0143 | 15.4592 | 0.18336 | 220,254 | Liq | −76.02° F. |
| 49 | 0.6841 | 77.13 | 229.688 | −39.4176 | 0.0488 | 15.7943 | 0.18336 | 220,254 | Liq | −59.01° F. |
| 70 | 0.3155 | 179.49 | 95.924 | 64.4458 | 0.2390 | 19.3477 | 0.03486 | 41,869 | Mix | 1 |
| 71 | 0.3155 | 141.13 | 40.340 | 64.4458 | 0.2423 | 17.6181 | 0.03486 | 41,869 | Mix | 0.9413 |
| 86 | 0.9967 | 66.06 | 95.274 | 547.4365 | 1.0689 | 74.9371 | 0.09133 | 109,705 | Mix | 0.0157 |
| 87 | 0.9967 | 66.06 | 95.274 | 547.4365 | 1.0689 | 74.9371 | 0.40736 | 489,336 | Mix | 0.0157 |
| 88 | 0.9967 | 107.62 | 95.424 | 584.0037 | 1.1357 | 76.8310 | 0.09133 | 109,705 | Mix | 0 |
| 89 | 0.9967 | 107.62 | 95.424 | 584.0037 | 1.1357 | 76.8310 | 0.40736 | 489,336 | Mix | 0 |
| 100 | 0.8750 | 85.33 | 3,060.000 | 23.9892 | 0.0855 | 60.9946 | 0.81664 | 980,976 | Liq | −321.64° F. |
| 101 | 0.8750 | 251.77 | 3,025.000 | 221.7558 | 0.4014 | 94.9272 | 0.81664 | 980,976 | Liq | −110.56° F. |
| 102 | 0.8400 | 542.54 | 2,975.000 | 768.2831 | 1.0500 | 304.8635 | 1.00000 | 1,201,231 | Pcr | |
| 103 | 0.8400 | 763.35 | 2,935.000 | 978.2536 | 1.2417 | 415.4298 | 1.00000 | 1,201,231 | Pcr | |
| 104 | 0.8400 | 1,087.82 | 2,900.000 | 1,242.9682 | 1.4350 | 579.8598 | 1.00000 | 1,201,231 | Pcr | |
| 105 | 0.8400 | 1,087.00 | 612.048 | 1,273.8240 | 1.6315 | 508.8217 | 1.00000 | 1,201,231 | Vap | 750.6° F. |
| 106 | 0.8400 | 763.35 | 644.261 | 1,038.7373 | 1.4554 | 365.0527 | 1.00000 | 1,201,231 | Pcr | |
| 107 | 0.8400 | 614.85 | 59.315 | 958.1267 | 1.6574 | 179.6671 | 1.00000 | 1,201,231 | Pcr | |
| 108 | 0.8400 | 292.55 | 56.349 | 769.6866 | 1.4556 | 95.9312 | 1.00000 | 1,201,231 | Vap | 96.3° F. |
| 109 | 0.8400 | 1,087.00 | 2,850.000 | 1,242.9682 | 1.4370 | 578.8525 | 1.00000 | 1,201,231 | Pcr | |
| 110 | 0.8400 | 355.98 | 56.933 | 805.0788 | 1.4995 | 108.5070 | 1.00000 | 1,201,231 | Vap | 159.2° F. |
| 111 | 0.8400 | 406.56 | 2,998.239 | 509.3456 | 0.7685 | 191.9405 | 1.00000 | 1,201,231 | Pcr | |
| 112 | 0.8750 | 406.56 | 2,998.239 | 533.7997 | 0.7922 | 204.2431 | 0.81664 | 980,976 | Pcr | |
| 113 | 0.8750 | 98.68 | 3,065.000 | 38.9575 | 0.1126 | 61.9106 | 0.81664 | 980,976 | Liq | −272.45° F. |
| 114 | 0.8750 | 325.97 | 3,015.561 | 331.8197 | 0.5483 | 128.8072 | 0.81664 | 980,976 | Liq | −42.96° F. |
| 115 | 0.8400 | 469.53 | 57.933 | 870.3169 | 1.5724 | 135.9579 | 1.00000 | 1,201,231 | Vap | 271.9° F. |
| 120 | 0.6841 | 82.95 | 3,060.000 | −26.5730 | 0.0519 | 27.0238 | 0.18336 | 220,254 | Liq | −348.97° F. |
| 121 | 0.6841 | 251.77 | 3,025.000 | 171.8327 | 0.3697 | 60.5604 | 0.18336 | 220,254 | Liq | −162.18° F. |
| 122 | 0.6841 | 406.56 | 2,998.239 | 400.4312 | 0.6586 | 139.3539 | 0.18336 | 220,254 | Liq | −47.19° F. |
| 123 | 0.6841 | 98.68 | 3,065.000 | −8.7957 | 0.0841 | 28.0688 | 0.18336 | 220,254 | Liq | −358.88° F. |
| 124 | 0.6841 | 325.97 | 3,015.561 | 269.4418 | 0.5002 | 90.5113 | 0.18336 | 220,254 | Liq | −77.99° F. |
| 129 | 0.8750 | 77.13 | 229.688 | 9.4597 | 0.0820 | 48.2811 | 0.81664 | 980,976 | Liq | −37.31° F. |
| 138 | 0.8400 | 243.00 | 40.340 | 744.0660 | 1.4584 | 68.8240 | 1.00000 | 1,201,231 | Vap | 62.5° F. |
| 149 | 0.6841 | 77.13 | 229.688 | −39.4176 | 0.0488 | 15.7943 | 0.18336 | 220,254 | Liq | −59.01° F. |
| | | | | | Heat Source | | | | | |
| 600 | GAS | 1,187.00 | 16.137 | 371.0954 | 0.4677 | 149.2063 | 4.37821 | 5,259,240 | Vap | 1071.7° F. |
| 601 | GAS | 1,187.00 | 16.137 | 371.0954 | 0.4677 | 149.2063 | 2.31887 | 2,785,502 | Vap | 1071.7° F. |
| 602 | GAS | 1,187.00 | 16.137 | 371.0954 | 0.4677 | 149.2063 | 2.05934 | 2,473,738 | Vap | 1071.7° F. |
| 603 | GAS | 778.35 | 15.865 | 256.9389 | 0.3893 | 75.7085 | 4.37821 | 5,259,240 | Vap | 663.7° F. |
| 605 | GAS | 778.35 | 15.865 | 256.9389 | 0.3893 | 75.7085 | 2.31887 | 2,785,502 | Vap | 663.7° F. |
| 606 | GAS | 778.35 | 15.865 | 256.9389 | 0.3893 | 75.7085 | 2.05934 | 2,473,738 | Vap | 663.7° F. |
| 607 | GAS | 599.85 | 15.746 | 208.9808 | 0.3480 | 49.1668 | 4.37821 | 5,259,240 | Vap | 485.4° F. |
| 608 | GAS | 277.55 | 15.531 | 125.1015 | 0.2547 | 13.6900 | 4.37821 | 5,259,240 | Vap | 163.6° F. |
| 609 | GAS | 111.83 | 15.415 | 79.9041 | 0.1852 | 4.5662 | 4.37821 | 5,259,240 | Mix | 0.003 |
| 610 | GAS | 340.98 | 15.566 | 141.3708 | 0.2757 | 19.0609 | 6.62477 | 7,957,881 | Vap | 227° F. |
| 611 | GAS | 599.85 | 15.746 | 208.9808 | 0.3480 | 49.1668 | 6.62477 | 7,957,881 | Vap | 485.4° F. |
| 612 | GAS | 277.55 | 15.531 | 125.1015 | 0.2547 | 13.6900 | 6.62477 | 7,957,881 | Vap | 163.6° F. |
| 613 | GAS | 113.68 | 15.422 | 83.4406 | 0.1913 | 4.9148 | 4.37821 | 5,259,240 | Vap | 0° F. |
| 615 | GAS | 451.18 | 15.637 | 169.8945 | 0.3088 | 30.4399 | 6.62477 | 7,957,881 | Vap | 337° F. |
| 616 | GAS | 111.83 | 15.415 | 79.8910 | 0.1852 | 4.5716 | 4.36588 | 5,244,425 | Mix | 0 |
| 617 | Water | 111.83 | 1.346 | 79.8999 | 0.1506 | 2.5220 | 0.01233 | 14,815 | Mix | 1 |
| 618 | GAS | 111.83 | 15.415 | 79.8910 | 0.1852 | 4.5716 | 4.36588 | 5,244,425 | Mix | 0 |
| 621 | GAS | 599.85 | 15.746 | 208.9808 | 0.3480 | 49.1668 | 2.24656 | 2,698,641 | Vap | 485.4° F. |
| 622 | GAS | 277.55 | 15.531 | 125.1015 | 0.2547 | 13.6900 | 2.24656 | 2,698,641 | Vap | 163.6° F. |
| | | | | | Coolant | | | | | |
| 50 | Water | 53.50 | 14.693 | 21.6278 | 0.0430 | 0.0723 | 59.6800 | 71,689,463 | Liq | −158.45° F. |
| 51 | Water | 53.59 | 24.693 | 21.7429 | 0.0431 | 0.1011 | 59.6800 | 71,689,463 | Liq | −185.77° F. |
| 52 | Water | 53.59 | 24.693 | 21.7429 | 0.0431 | 0.1011 | 32.5665 | 39,119,840 | Liq | −185.77° F. |
| 53 | Water | 65.52 | 14.693 | 33.6624 | 0.0661 | 0.0836 | 32.5665 | 39,119,840 | Liq | −146.43° F. |
| 54 | Water | 53.59 | 24.693 | 21.7429 | 0.0431 | 0.1011 | 22.6950 | 27,261,956 | Liq | −185.77° F. |

TABLE IV-continued

SBC-16/CTCSS K28a
System Point Summary
Working Fluid: Ammonia/Water
SBC-16 GE 9FB 53.5 F.

| Pt. | X lb/lb | T ° F. | P psia | H Btu/lb | S Btu/lb-R | Ex Btu/lb | G rel G/G = 1 | G abs lb/h | Ph. | Wetness lb/lb/T ° F. |
|---|---|---|---|---|---|---|---|---|---|---|
| 55 | Water | 65.16 | 14.693 | 33.2996 | 0.0655 | 0.0792 | 22.6950 | 27,261,956 | Liq | −146.79° F. |
| 56 | Water | 53.59 | 24.693 | 21.7429 | 0.0431 | 0.1011 | 4.41853 | 5,307,668 | Liq | −185.77° F. |
| 57 | Water | 75.52 | 14.693 | 43.6534 | 0.0850 | 0.3003 | 4.41853 | 5,307,668 | Liq | −136.44° F. |
| 58 | Water | 66.12 | 14.693 | 34.2641 | 0.0673 | 0.0914 | 59.6800 | 71,689,463 | Liq | −145.83° F. |
| 60 | Water | 0.00 | 14.693 | 33.5134 | 0.0000 | 0.0000 | 55.2615 | 66,381,795 | Mix | 0 |

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

I claim:

1. A condensation and thermal compression system comprising:

a separation subsystem comprising a first separator, a second separator, a third separator, a scrubber and a third throttle control valve, where the separation subsystem produces rich vapor streams and lean liquid streams and where the third separator produces a rich third separator vapor stream, which is combined with a fully condensed basic solution stream to form an enriched basic solution;

a heat exchange subsystem comprising a first heat exchange unit, a second heat exchange unit, a third heat exchange unit, a first throttle control valve, a second throttle control valve, a fourth throttle control valve, a fifth throttle control valve, a sixth throttle control valve, and a seventh throttle control valve, where the heat exchange subsystem cools streams derived from an entering stream, heats a pressurized first enriched basic solution substream splits the pressurized first enriched basic solution substream into substreams, and pressure adjusts the substreams for subsequence use, and pressure adjusting the lean stream and mixes the pressure adjusted lean streams with the entering stream to form a partially condensed basic solution stream and where the entering stream is mixed with an amount of a one of the pressure adjusted lean stream so that entering stream is in a state of saturated vapor;

a first condensing and pressurizing subsystem comprising a first condenser, a first pump, and a fourth pump, where the partially condensed basic solution stream is fully condensed to form a fully condensed basic solution stream, where the fully condensed basic solution stream is pressurized to form a pressurized fully condensed basic solution stream, where a rich vapor stream from the third separator is mixed with the fully condensed basic solution stream to form an enriched basic solution stream, where the enriched basic solution stream is pressurized to form the pressurized enriched basic solution stream and where the pressurized enriched basic solution stream is split into the first pressurized enriched basic solution stream and a second pressurized enriched basic solution substream; and a second condensing and pressurizing subsystem comprising a second condenser, a second pump, a third condenser, a third pump, a fifth pump and a heat exchange unit, where a partially condensed lean solution stream comprising a pressure adjusted second pressurized enriched basic solution substream and a rich second separator vapor stream is fully condensed to form a fully condensed lean solution stream, where the fully condensed lean solution stream is pressurized to form a pressurized fully condensed lean solution stream, where the pressurized fully condensed lean solution stream is split into a first lean solution substream and a second lean solution substream, where the second lean solution substream is pressurized to form a pressurized second lean solution stream, where the first lean solution substream is mixed with a cooled rich scrubber vapor stream to form a rich solution stream, where the rich solution stream is fully condensed to form a fully condensed rich solution stream, where the fully condensed rich solution stream is pressurized to form a pressurized rich solution stream, and where a rich scrubber vapor stream is cooled, while the rich solution stream and the second lean solution substream are heated to form a heated rich solution stream, a heated lean solution stream and the cooled rich scrubber vapor stream.

2. The system of claim 1, wherein the composition of the streams are derived from a multi-component stream comprising an ammonia-water mixture, a mixture of two or more hydrocarbons, a mixture of two or more freons, or a mixture of hydrocarbons and freons.

3. The system of claim 2, wherein the multi-component stream comprises a mixture of water and ammonia.

4. The system of claim 1, wherein the multi-component stream comprises a mixture of water and ammonia.

5. The system of claim 1, wherein a flow rate of the second lean solution substream is zero and the system produces only the rich solution stream.

6. The system of claim 1, wherein the heated lean solution stream and the heated rich solution stream have the same composition.

7. The system of claim 1, wherein the heated lean solution stream and the heated rich solution stream have different compositions, the rich solution stream has a higher concentration of lower boiling point component than the lean solution stream.

8. A method comprising:

mixing an incoming stream (S138) and an amount of a pressure adjusted first lean liquid first substream (S71) to form a combined stream (S38), where the amount is sufficient for the combined stream (S38) to be in a state of saturated vapor;

bringing the combined stream (S38) into a heat exchange relationship with a further heated enriched basic solution stream (S11) to form a cooled combined stream (S15) and a partially vaporized enriched basic solution stream (S5), mixing the cooled combined stream (S15) with a pressure adjusted combined lean liquid stream (S8) comprising a first lean liquid second substream (S4) and a lean scrubber stream (S35) to form a leaner stream (S16), bringing the leaner stream (S16) into a heat exchange relationship with a heated enriched basic solution third substream (S12) to form the further heated enriched basic solution stream (S11) and a cooled leaner stream (S17), dividing a heated enriched basic solution first substream 514 into a heated enriched basic solution fourth substream (S13), a heated enriched basic solution fifth substream (S21), and the heated enriched basic solution third substream (S12), bringing the cooled leaner stream (S17) into a heat exchange relationship with an enriched basic solution first substream (S44) to form the heated enriched basic solution first substream (S14) and a partially condensed leaner stream (S18), mixing the partially condensed leaner stream (S18) with a pressure adjusted third lean liquid stream (S41) to form a basic solution stream (S19), bringing the basic solution stream (S19) into a heat exchange relationship with an external coolant to form a fully condensed basic solution stream (S1), pressurizing the fully condensed basic solution stream (S1) to form a pressurized fully condensed basic solution stream (S2), mixing the pressurized fully condensed basic solution stream (S2) with a rich third vapor stream (S39) to form an enriched basic solution stream (S24), pressurizing the enriched basic solution stream (S24) to form a pressurized; enriched basic solution stream (S20), dividing the pressurized enriched basic solution stream (S20) into an enriched basic solution first substream (S44) and an enriched basic solution second substream (S36), separating the partially vaporized enriched basic solution stream (S5) into a first rich vapor stream (S6) and a first lean liquid stream (S7), dividing the first lean liquid stream (S7) into a first lean liquid first substream (S70) and a first lean liquid second substream (S4), pressure adjusting the first lean liquid first substream (S70) to form the pressure adjusted first lean liquid first substream (S71), mixing the first lean liquid second substream (S4) with a lean liquid scrubber stream (S35) to form a combined lean liquid stream (S9), pressure adjusting the combined lean liquid stream (S9) to form the pressure adjusted combined lean liquid stream (S8), pressure adjusting the heated enriched basic solution fifth substream (S21) to form a pressure adjusted heated enriched basic solution fifth substream (S10), forwarding the first rich vapor stream (S6) into a lower port of a scrubber (SC1) and the pressure adjusted heated enriched basic solution fifth substream (S10) into an upper port of the scrubber (SC1) to form a rich vapor scrubber stream (S30) and the lean liquid scrubber stream (S35), pressure adjusting the enriched basic solution second substream (S36) to form a pressure adjusted enriched basic solution second substream (S31), pressure adjusting the enriched basic solution fourth substream (S13) to form a pressure adjusted enriched basic solution fourth substream (S43), separating the pressure adjusted enriched basic solution fourth substream (S43) into a second rich vapor stream (S34) and a second lean liquid stream (S32), pressure adjusting the second lean liquid stream (S32) to form a pressure adjusted second lean liquid stream (S42), separating the pressure adjusted second separator lean liquid stream (S42) into a third rich vapor stream (S39) and a third lean liquid stream (S47), pressure adjusting the third lean liquid stream (S47) to form the pressure adjusted third lean liquid stream (S41), mixing the second rich vapor stream (S34) and the pressure adjusted second pressurized enriched basic solution second stream (S31) to form a lean solution stream (S3), bringing the lean solution stream (S3) into a heat exchange relationship with an external coolant to form a fully condensed lean solution stream (S23), pressurizing the fully condensed lean solution stream (S23) to form a pressurized fully condensed lean solution stream (S40), dividing the pressurized fully condensed lean solution stream (S40) into a first lean solution substream (S46) and a second lean solution substream (S45), mixing the second lean solution substream (S45) and a cooled rich vapor scrubber stream (S25) to form a rich solution stream (S26), bringing the rich solution stream (S26) into a heat exchange relationship with an external coolant to form a fully condensed rich solution stream (S27), pressurizing the fully condensed rich solution stream (S27) to form a pressurized fully condensed rich solution stream (S28), pressurizing the first lean solution substream (S46) to form a pressurized fully condensed lean solution stream (S48), and bringing the pressurized fully condensed rich solution stream (S28), the pressurized fully condensed lean solution stream (S48) and the rich vapor scrubber stream (S30) into a heat exchange relationship to form the cooled rich vapor scrubber stream (S25), a heated first fully condensed lean solution stream (S49) and a heated fully condensed rich solution stream (S29).

9. The method of claim 8, wherein the composition of the streams are derived from a multi-component stream comprising an ammonia-water mixture, a mixture of two or more hydrocarbons, a mixture of two or more freons, or a mixture of hydrocarbons and freons.

10. The method of claim 8, wherein the multi-component stream comprises a mixture of water and ammonia.

11. The method of claim 8, wherein the multi-component stream comprises a mixture of water and ammonia.

12. The method of claim 8, wherein a flow rate of the first lean solution substream (S46) is zero and the system produces only the heated fully condensed rich solution stream (S29).

13. The method of claim 8, wherein the heated fully condensed lean solution stream and the heated fully condensed rich solution stream have the same composition.

14. The method of claim 8, wherein the heated fully condensed lean solution stream and the heated fully condensed rich solution stream have different compositions, the first solution being a lean solution and the second solution being a rich solution.

15. A bottoming cycle system comprising:

a heat recovery vapor generator subsystem including:

a preheater section for preheating at least one higher pressure stream with heat derived from a gaseous heat source stream;

an intercooler section for vaporizing the higher pressure streams with heat derived from the gaseous heat source stream and a lower pressure working solution stream to form a cooled lower pressure working solution stream, if more than one stream enters the heat recovery vapor generator subsystem, then the streams are combined to from a working solution stream and the combination is performed at a point in the heat recovery vapor generator subsystem, where a temperature of the combined working solution stream has the same or substantially the same temperature as the two streams prior to being combined;

a mid temperature section for heating the vaporized higher pressure working solution stream with heat derived from the gaseous heat source stream; and a superheater/reheater section for superheating the higher pressure working solution stream to form a superheated higher pressure working solution stream and for reheating an intermediate working solution stream with heat derived from the gaseous heat source stream to form a reheated intermediate pressure working solution;

a multi-stage energy conversion or turbine subsystem including:

a high pressure turbine or turbine stage for converting a portion of thermal energy in the superheated higher pressure working solution stream into a first portion of useable energy to form an intermediate pressure working solution stream;

an intermediate pressure turbine or turbine stage for converting a portion of thermal energy in the reheated intermediate pressure working solution stream into a second portion of useable energy to form a spent working solution stream; and a condensation thermal compression subsystem including four heat exchange units, three condensing units, a first separators, a second separator, a third separator, a scrubber and seven throttle control valves condenses the spent working solution stream to from the at least one fully condensed stream, where the third separator forms a rich vapor stream that is used to form an enriched basic solution stream, a portion of which is heated by the spent working solution stream.

16. The apparatus of claim 15, wherein turbine subsystem further includes:

a lower pressure turbine or turbine stage for converting a portion of thermal energy in the cooled lower pressure working solution stream into a third portion of usable energy to form the spent working solution stream.

17. The system of claim 15, wherein the condensation thermal compression subsystem further includes a plurality of pumps, a plurality of mixing valves and a plurality of splitting valves arranged to efficiently convert the spent working fluid stream into the at least one fully condensed working fluid stream by forming streams of different compositions, pressures and temperatures and using an external coolant stream to fully condense streams derived from the spent working fluid stream into the fully condensed streams.

18. The system of claim 15, wherein the preheater comprises a preheater section of the heat recovery vapor generator subsystem.

19. The system of claim 15, wherein the intercooler comprises an intercooler section of the heat recovery vapor generator subsystem.

20. The system of claim 15, wherein the superheater comprises a mid temperature sections and a high temperature section of the heat recovery vapor generator subsystem.

21. The system of claim 15, wherein the reheater comprises a high temperature section the heat recovery vapor generator subsystem.

22. The system of claim 15, wherein the working fluid is a multi-component fluid.

23. The system of claim 22, wherein the multi-component fluid comprises an ammonia-water mixture, a mixture of two or more hydrocarbons, a mixture of two or more freons, or a mixture of hydrocarbons and freons.

24. The system of claim 23, wherein the composition of the incoming multi-component stream comprises a mixture of water and ammonia.

25. A bottoming cycle method comprising the steps of:

pressurizing at least one fully condensed stream in feed pumps to form higher pressure fully condensed stream, bringing the higher pressure, fully condensed streams into a first heat exchange relationship with a gaseous heat source stream in a preheater section of a heat recovery vapor generator subsystem to form a spent gaseous heat source stream and preheated, higher pressure streams;

bringing the preheated, higher pressures streams into a second heat exchange relationship with the gaseous heat source stream and a lower pressure working solution stream in an intercooler section of the heat recovery vapor generator subsystem to form vaporized, higher pressure streams and a cooled lower pressure working solution;

if there are more than one fully condensed streams entering the, then combining the streams in the intercooler section of the heat recovery vapor generator subsystem to form a vaporized higher pressure, working solution stream, where the streams are combined at a point, where a temperature vaporized working solution stream is the same or substantially the same as a temperature of the two vaporized streams, bringing the vaporized, higher pressure working solution stream into a third heat exchange relationship with the gaseous heat source stream in a mid temperature section of the heat recovery vapor generator subsystem to form a heated vaporized, higher pressure working solution stream;

bringing the heated vaporized, higher pressure working solution stream into a fourth heat exchange relationship with the gaseous heat source stream in a high temperature section of the heat recovery vapor generator subsystem to form a superheated higher pressure working solution stream;

converting a portion of thermal energy in the superheated, higher pressure working solution stream into a first portion of a usable form of energy in a high pressure turbine or turbine stage to form an intermediate pressure working solution stream;

bringing the intermediate pressure working solution stream into a fifth heat exchange relationship with the gaseous heat source stream in the high temperature section of the heat recovery vapor generator subsystem to form a reheated, intermediate pressure working solution stream;

converting a portion of thermal energy in the reheated, intermediate pressure working solution stream into a second portion of the usable form of energy in intermediate pressure turbine or turbine stage to form the lower pressure working solution stream; and condensing a spent working solution stream in a condensation thermal compression subsystem to form the fully condensed streams, where the spent stream comprising the lower pressure working solution stream.

26. The method of claim 25, further comprising the steps of:

prior to the condensing step, converting a portion of thermal energy in the lower pressure working solution stream into a third portion of the usable form of energy in a lower pressure turbine or turbine stage to form the spent working solution stream.

27. The method of claim 25, wherein the working fluid is a multi-component fluid.

28. The method of claim 27, wherein the multi-component fluid comprises an ammonia-water mixture, a mixture of two or more hydrocarbons, a mixture of two or more freons, or a mixture of hydrocarbons and freons.

29. The method of claim 28, wherein the multi-component stream comprises a mixture of water and ammonia.

30. The method of claim 25, wherein the CTCSS comprising:

a separation subsystem comprising a first separator, a second separator, a third separator, a scrubber, and a third throttle control valve adapted to produce rich vapor streams and lean liquid streams, where the third separator produces a third rich vapor stream used to form an enriched basic solution;

a heat exchange subsystem comprising a first heat exchanger, a second heat exchanger, a third heat exchanger, a first throttle control valve, a second throttle control valve, a fourth throttle control valve, a fifth throttle control valve, a sixth throttle control valve and a seventh throttle control valve, where the heat exchange subsystem cools streams derived from an entering stream, heats a pressurized enriched basic solution stream, splits the pressurized enriched basic solution stream into substreams, pressure adjusts the substreams for subsequence use, and mixes pressure adjusted lean streams with the entering stream to form a partially condensed basic solution stream and where the entering stream is mixed with an amount of a pressure adjusted lean stream sufficient that the entering stream is in a state of saturated vapor;

a first condensing and pressurizing subsystem comprising a first condenser, a first pump, a fourth pump, where the partially condensed basic solution stream is fully condensed to form a fully condensed basic solution stream, where the fully condensed basic solution stream is pressurized to form a pressurized fully condensed basic solution stream, where a third rich vapor stream from the third separator is mixed with the pressurized fully condensed basic solution stream to form an enriched basic solution stream, where the enriched basic solution stream is pressurized to form the pressurized enriched basic solution stream and where the pressurized enriched basic solution stream is split into the pressurized enriched basic solution first substream and a pressurized enriched basic solution second substream; and a second condensing and pressurizing subsystem comprising a second condenser, a second pump, a third condenser, a third pump, a fifth pump and a heat exchange unit, where a partially condensed lean solution stream is fully condensed to form a fully condensed lean solution stream, where the fully condensed lean solution stream is pressurized to form a pressurized fully condensed lean solution stream, where the pressurized fully condensed lean solution stream is split into a first pressurized fully condensed lean solution substream and a second pressurized fully condensed lean solution substream, where the second pressurized fully condensed lean solution substream is pressurized to form a pressurized fully condensed lean solution stream, where the first pressurized fully condensed lean solution substream is mixed with a cooled rich vapor scrubber stream to form a rich solution stream, where the rich solution stream is fully condensed to form a fully condensed rich solution stream, where the fully condensed rich solution stream is pressurized to form a pressurized fully condensed rich solution stream, and where a rich vapor scrubber stream is cooled, while the pressurized fully condensed rich solution stream and the pressurized fully condensed rich solution stream are heated to form a heated fully condensed rich solution stream, a heated fully condensed lean solution stream and the cooled rich vapor scrubber stream.

31. The method of claim 30, wherein a flow rate of the second pressurized fully condensed lean solution stream is zero and the system produces only the heated fully condensed rich solution stream.

32. The method of claim 30, wherein the heated fully condensed lean solution stream and the heated fully condensed rich solution stream have the same composition.

33. The method of claim 30, wherein the heated fully condensed lean solution stream and the heated fully condensed rich solution stream have different compositions, the first solution being a lean solution and the second solution being a rich solution.

* * * * *